US005989108A

United States Patent [19]

Ikeda et al.

[11] Patent Number: 5,989,108

[45] Date of Patent: Nov. 23, 1999

[54] DOUBLE SIDE GRINDING APPARATUS FOR FLAT DISKLIKE WORK

[75] Inventors: Junzo Ikeda; Toshio Ishii; Shizuki Sasakura; Yasuo Yoshimura; Koichi Ueda, all of Yao, Japan

[73] Assignee: Koyo Machine Industries Co., Ltd., Osaka, Japan

[21] Appl. No.: 08/924,532

[22] Filed: Sep. 5, 1997

[30] Foreign Application Priority Data

| | | | |
|---|---|---|---|
| Sep. 9, 1996 | [JP] | Japan | 8-238002 |
| Dec. 20, 1996 | [JP] | Japan | 8-341971 |
| Feb. 7, 1997 | [JP] | Japan | 9-025161 |

[51] Int. Cl.[6] ..... B24B 7/17

[52] U.S. Cl. ..... 451/268; 451/397

[58] Field of Search ..... 451/63, 268, 112, 451/269, 265, 274, 397, 402

[56] References Cited

U.S. PATENT DOCUMENTS

| | | | |
|---|---|---|---|
| 4,393,628 | 7/1983 | Ottman et al. | 451/63 |

FOREIGN PATENT DOCUMENTS

| | | | |
|---|---|---|---|
| 5125976 | 9/1980 | Japan | 451/287 |
| 3127872 | 5/1988 | Japan | 451/63 |

*Primary Examiner*—Robert A. Rose

*Attorney, Agent, or Firm*—Thelen Reid & Priest

[57] ABSTRACT

A double side grinding apparatus for thin disklike work comprises a pair of rotatable grinding wheels having opposed circular grinding faces provided by respective end faces and so arranged as to be movable relative to each other axially thereof, and work rotating means for rotating the thin disklike work about its own axis while supporting the work in a grinding position between the grinding faces so that opposite surfaces of the work to be worked on face the respective grinding faces of the pair of the wheels, with an outer periphery of the work intersecting an outer periphery of each grinding face and with the center of the work positioned inwardly of the grinding faces.

16 Claims, 23 Drawing Sheets

DOUBLE SIDE GRINDING APPARATUS FOR FLAT DISKLIKE WORK

BACKGROUND OF THE INVENTION

The present invention relates to double side grinding apparatus for thin disklike work, and more particularly to an apparatus for simultaneously grinding opposite surfaces of thin disklike work such as semiconductor wafers.

Apparatus for grinding opposite surfaces of work at the same time are already known which comprise a pair of rotatable grinding wheels having respective grinding end faces opposed to each other for positioning the work as placed in a pocket (aperture) of a rotatable disklike carrier. In this case, the grinding faces of the wheels need to be greater than the work in outside diameter. The carrier is usually formed with a plurality of pockets as equidistantly spaced apart and arranged on a circumference closer to the outer periphery of the carrier. While a portion of the carrier is positioned also between the pair of grinding wheels along with the work, the thickness of this portion of the carrier must of course be smaller than the distance between the pair of wheels as positioned for grinding, i.e., the thickness of the finished work.

The semiconductor wafers present in use include those measuring about 200 mm (8 inches) and those measuring about 300 mm (12 inches) in outside diameter. The wafers of either type (as finished by grinding) have a thickness of about 0.8 mm which is extremely small as compared with the outside diameter. For use in grinding such wafers which are relatively great in outside diameter, the grinding wheels have an increased outside diameter, and the carrier to be rotated with the wafer accommodated therein also has an increased size, consequently rendering the apparatus large-sized. Further because the wafers are thin, the carrier portion to be positioned between the grinding wheels along with the wafer must be greatly reduced in thickness. The grinding force acts on the carrier placed between the grinding wheels, especially on the pocket portion thereof, through the work accommodated. When reduced in thickness, this portion has impaired strength and encounters difficulty in smoothly moving the work. For this reason, it has been difficult to grind opposite surfaces of wafers.

The same problems as above are also experienced with thin disklike workpieces other than wafers.

SUMMARY OF THE INVENTION

An object of the present invention is to provide an apparatus which is adapted to grind both surfaces of thin disklike work at the same time with ease to give the resulting product a high quality and which can nevertheless be compacted.

The present invention provides an apparatus which is characterized in that the apparatus comprises a pair of rotatable grinding wheels having opposed circular grinding faces provided by respective end faces and so arranged as to be movable relative to each other axially thereof, and work rotating means for rotating thin disklike work about its own axis while supporting the work in a grinding position between the grinding faces so that opposite surfaces of the work to be worked on face the respective grinding faces of the pair of the wheels, with an outer periphery of the work intersecting an outer periphery of each grinding face and with the center of the work positioned inwardly of the grinding faces.

The work rotating means rotates the work as supported in the grinding position, and the pair of grinding wheels are rotated with their grinding faces in contact with the respective work surfaces to be ground. The rotation of the grinding wheels grinds the work surfaces in contact with the grinding faces of the wheels. The work rotates about its own axis with the outer periphery of the work intersecting the outer peripheries of the grinding faces and with the center of the work positioned inwardly of the grinding faces, with the result that while the work makes one turn of rotation, the entire work surfaces, which are positioned between the grinding faces, move past the respective grinding faces in contact therewith. Accordingly, both work surfaces can be entirely ground at the same time merely by rotating the work about its own axis between the grinding wheels, the grinding faces thereof having an outside diameter slightly greater than the radius of the work. The work needs only to be rotated at the grinding position, and there is no need to use the carrier or the like conventionally used. The work can therefore be ground easily and reliably even if it is in the form of a thin disk. Moreover, the apparatus can be compacted. The work surfaces can be entirely ground with use of grinding wheels the grinding faces of which have an outside diameter slightly greater than the radius of the work. Thus, there is no need to use large grinding wheels the grinding faces of which are greater than the work in outside diameter. The apparatus can be compacted also because of this feature.

For example, the work rotating means comprises means for reciprocatingly moving the work in directions parallel to the grinding faces while rotating the work about its own axis.

The work can then be ground while being rotated about its own axis and reciprocatingly moved in directions parallel to the grinding faces. This improves the flatness and surface roughness of the work especially at its central portion.

For example, the work rotating means comprises radial support means for defining the position of the work radially thereof, and axial support means for defining the position of the work axially thereof, at least one of the radial support means and the axial support means being provided with drive means for rotating the work.

In this case, the radial support means comprises, for example, at least three radial support rollers adapted to contact the outer periphery of the work at a portion thereof projecting outward from between the grinding wheels to define the position of the work radially thereof.

The work can then be reliably supported by the radial support rollers radially of the work.

Semiconductor wafers include those having a positioning flat portion formed by cutting out an outer peripheral part of the wafer along a chord, and those having no flat portion.

In the case where the work is substantially perfectly circular and has no positioning flat portion, one radial support roller is disposed at each of three locations, preferably at a location close to each of positions dividing the circumference of the work into three equal parts. The work can then be reliably supported radially thereof with use of a minimum number of rollers required.

In the case where the work is formed with a positioning flat portion, a pair of radial support rollers are arranged at each of three locations, preferably at a location close to each of positions dividing the circumference of the work into three equal parts, the pair of rollers being spaced apart by a distance slightly greater than the circumferential dimension of the flat portion. The work with the flat portion can then be reliably supported radially thereof by six rollers.

When the radial support means comprises at least three radial support rollers as described above, the axial support means comprises, for example, at least three pairs of axial support rollers adapted for pressing contact with the work surfaces to hold therebetween the work portion projecting outward from between the grinding wheels and to define the position of the work axially thereof, at least one of the axial support rollers being a drive roller rotatable in pressing contact with the work surface to rotate the work, the other axial support rollers being holding rollers idly rotatable in pressing contact with the work surface.

The work can then be reliably rotated about its own axis as reliably supported axially thereof by the axial support rollers.

It is desired that at least three pairs of axial support rollers be arranged in closest proximity to respective positions dividing the circumference of the work into three equal parts. When the work is driven as supported by the axial support rollers at at least three locations, preferably in the vicinity of the positions dividing the circumference into three equal parts, the work can be supported more reliably and is rotatable more smoothly.

For example, among the axial support rollers, those on one side of the work are pressed into contact with one of the work surfaces by an elastic force to press the other work surface into contact with the other axial support rollers on the other side.

The axial support rollers can then be reliably pressed into contact with the work with the elastic force, whereby the work can be supported axially thereof more reliably and rotated more reliably.

For example, the axial support rollers on one side of the work are all holding rollers and are attached to a common first support member, and the radial support rollers and the axial support rollers including the drive roller and disposed on the other side are attached to a common second support member, the support members being movable relative to each other in the axial direction.

This arrangement makes it possible to readily load the work into the work rotating device by bringing the work into contact with the radial support rollers and the axial support rollers attached to the second support member, with the two support members positioned axially away from each other, to position the work in place and moving the two support members toward each other to bring the axial support rollers attached to the first support member into pressing contact with the work.

When the radial support means comprises at least three radial support rollers as stated above, the axial support means comprises, for example, a pair of drive belts movable in contact with two portions of one of the work surfaces projecting outward from between the grinding wheels to rotate the work, and axial support rollers adapted for pressing contact with the other work surface to hold the work between each drive belt and each axial support roller.

The work can then be rotated as reliably supported only by a small number of radial support rollers providing the radial support means, a small number of axial support rollers providing the axial support means and the drive belts. This simplifies the apparatus in construction and renders the apparatus compacted.

For example, the pair of drive belts are arranged in parallel to each other and each have a work support portion with a surface facing upward for contact with the work, the pair of drive belts being drivable in a work loading state in which the work support portions move in the same loading direction to load the work as placed thereon in the grinding position, a work unloading state in which the work support portions move in the same unloading direction to unload the work as placed thereon from the grinding position, or a work rotating state in which the work support portions move in directions opposite to each other to rotate the work as placed thereon, as changed over from one of the states to another, the axial support rollers being movable upward and downward between a standby position wherein the rollers are upwardly away from the work on the drive belts and an operating position wherein the rollers are in pressing contact with the work on the drive belt, the radial support means comprising at least two fixed radial support rollers for stopping the work by coming into contact with the outer periphery of the work as transported by the pair of drive belts in the work loading state at a forward work portion with respect to the direction of transport, and at least one movable radial support roller adapted to come into contact with the outer periphery of the work as stopped by the fixed radial support rollers at a rearward work portion with respect to the direction of transport, the movable radial support roller being movable upward and downward between a standby position wherein the roller is upwardly away from the work on the drive belts and an operating position wherein the roller is in contact with the outer periphery of the work on the drive belt.

When merely placed onto the upper surfaces of the work support portions of the drive belt, the work can be loaded into the grinding position by the work support portions of the belts, then ground while being rotated about its own axis at this position, and unloaded from the position on completion of grinding. The drive belts for rotating the work are also operable for loading and unloading the work. The apparatus can therefore be simplified and compacted in construction.

For example, the work support portions of the pair of drive belts are each guided by a guide member disposed thereunder.

The pressing contact force of the axial support roller can then be received by the guide member, which prevents the drive belt from deforming. As a result, the work can be reliably supported in position axially thereof.

For example, each axial support roller and the movable radial support roller are attached to a lift member and movable upward and downward as timed with each other.

Thus, the axial support rollers and the movable radial support roller can be moved upward and downward at the same time by the single lift member. This simplifies the apparatus in construction and operation, further making the apparatus compact.

For example, the axial support means is of the static pressure type for supplying a fluid to the opposite surfaces of the work at a portion thereof projecting outward from between the grinding wheels to contactlessly support the work axially thereof with the static pressure of the fluid, the radial support means being provided with the drive means.

The work can then be supported reliably since the axial support means supports the work contactlessly with a static pressure. This mode of support obviates the likelihood of defacement of the work surfaces which are completely ground, assuring the worked surfaces of high quality. Moreover, since the axial support means is merely adapted to supply a fluid to the opposite work surfaces, the apparatus can be simplified in construction and compacted.

In the case where the axial support means is of the static pressure type as described above, the radial support means comprises, for example, at least two radial support rollers adapted to contact the outer periphery of the work to define the position of the work radially thereof, at least one of the radial support rollers being a drive roller for rotating the work.

When work having no positioning flat portion is to be ground as supported vertically, the two radial support rollers are brought into contact with the outer periphery of the work at respective two lower portions thereof, and at least one of these rollers is made to serve as a drive roller, whereby the work can be rotated as supported in position radially thereof.

When the work having no positioning flat portion is to be ground as supported horizontally, the radial support roller is contacted with the outer periphery of the work at each of three locations, preferably at a location proximate to each of the positions dividing the work outer periphery into three equal parts, and at least one of these rollers is made to serve as a drive roller. The work can then be rotated smoothly as reliably supported in position radially thereof.

When the work having no positioning flat portion is to be ground as supported vertically, it is desired to cause three radial support rollers to contact three respective outer peripheral portions of the work as in the foregoing case wherein the work is ground as supported horizontally, with two of the rollers for contact with two lower outer peripheral portions and with the other roller for contact with one upper peripheral portion, and to make at least one of these rollers to serve as a drive roller.

When work having a positioning flat portion is to be ground as supported vertically, the two radial support rollers are spaced apart by a distance slightly greater than the circumferential dimension of the flat portion and brought into contact with the outer periphery of the work at respective two lower portions thereof, and at least two rollers are made to serve as drive rollers, whereby the work can be rotated as supported in position radially thereof.

When the work having a positioning flat portion is to be ground as supported horizontally, two radial support rollers are spaced apart by a distance slightly greater than the circumferential dimension of the flat portion and are contacted with the outer periphery of the work at each of three locations, preferably at a location proximate to each of the positions dividing the work outer periphery into three equal parts, and at least two of the rollers are made to serve as drive rollers. The work can then be smoothly rotated as reliably supported in position radially thereof. Alternatively in this case, two radial support rollers may be provided at each of two locations among the three, and one radial support roller may be provided at the remaining one location so as to be movable radially of the work and adapted to come into contact with the work outer periphery by the elastic force of a spring or the like.

When the work having a positioning flat portion is to be ground as supported vertically, it is desired to cause three radial support rollers to contact three respective outer peripheral portions of the work as in the foregoing case wherein the work is ground as supported horizontally, with two of the rollers for contact with two lower outer peripheral portions and with the other roller for contact with one upper peripheral portion, and to make at least two of these rollers to serve as drive rollers.

In the case where the axial support means is of the static pressure type as described above, each of the grinding wheel is, for example, cuplike and has an outer peripheral portion with an annular end face serving as the grinding face, the radial support means comprising at least two radial support rollers adapted to contact the outer periphery of the work to define the position of the work radially thereof, one of the radial support rollers being attached to the center of one of the grinding wheels inwardly of the grinding face thereof so as to be rotatable about the axis of said one grinding wheel and to contact the outer periphery of the work at a portion thereof positioned between the grinding wheels, the other radial support roller being adapted to contact the outer periphery of the work at a portion thereof projecting outward from between the grinding wheels and positioned externally of the axial support means, one of the radial support rollers being a drive roller for rotating the work.

The work can then be reliably supported radially thereof by a small number of radial support rollers, and reliably rotated by the drive roller. Since one of the radial support rollers is attached to the center of the grinding wheel and positioned inwardly of the grinding face without projecting outwardly of the face, the apparatus can be compacted correspondingly.

In the case where the axial support means is of the static pressure type as described above, the radial support means comprises, for example, at least two pairs of radial support rollers adapted to contact the outer periphery of the work at a portion thereof projecting outward from between the grinding wheels and positioned externally of the axial support means to define the position of the work radially thereof, each of the pairs of radial support rollers being spaced apart by a distance greater than the circumferential dimension of a positioning flat portion formed in the outer periphery of the work, at least two of the radial support rollers being drive rollers for rotating the work.

The work can then be rotated as supported in position radially thereof regardless of whether the work has the positioning flat portion.

In the case where the axial support means is of the static pressure type as described above, the radial support means comprises, for example, a pair of belts so arranged as to come into contact with the outer periphery of the work by holding the work from radial opposite sides at a portion thereof projecting outward from between the grinding wheels and positioned externally of the axial support means and to be movable circumferentially of the work, at least one of the belts being a drive belt drivable circumferentially of the work to thereby rotate the work.

The work can then be rotated as reliably supported radially thereof using one pair of belts. This simplifies the apparatus in construction, making the apparatus further compacted. Since the belts which are flexible are brought into contact with the outer periphery of the work for supporting, the work can be rotated about its own axis with the periphery thereof reliably supported.

In the case where the axial support means is of the static pressure type as described above, the radial support means comprises, for example, shoes adapted to contact the outer periphery of the work at predetermined two portions thereof, the work being rotatable by the rotational force of the grinding wheels and the operation of the shoes.

The work can then be rotated as supported radially thereof only by the two shoes, so that the apparatus can be simplified in construction and compacted. Furthermore, the work is rotatable utilizing the rotational force of the grinding wheels. Thus, the apparatus requires no other power source and can therefore be simplified in construction and compacted.

DESCRIPTION OF THE PREFERRED EMBODIMENTS

Figure 1:
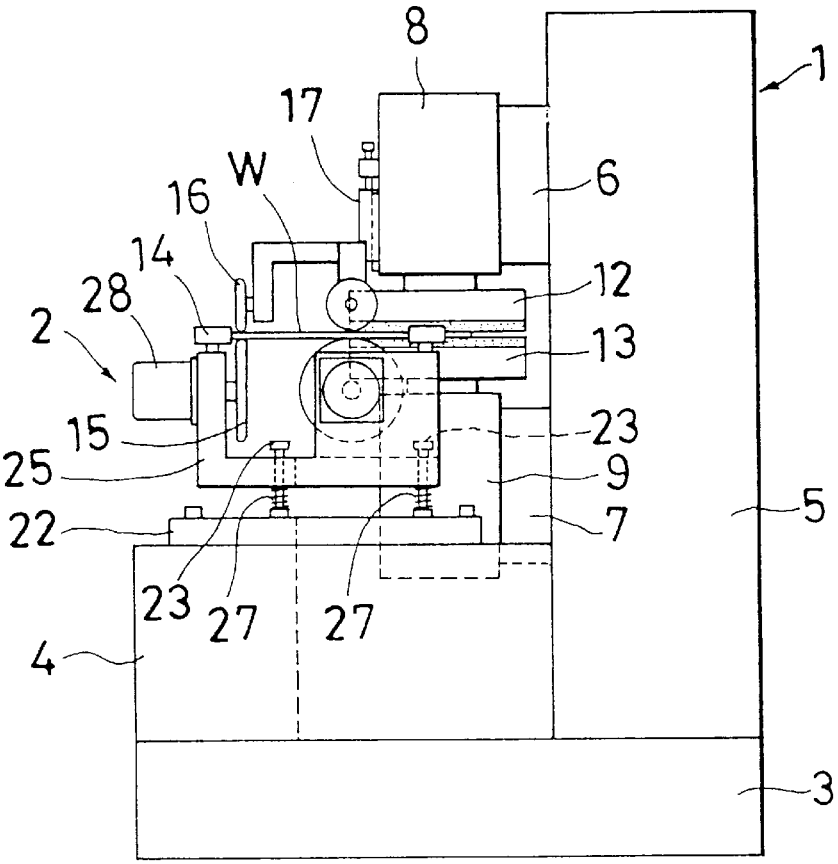
FIG. 1 is a side elevation schematically showing double side grinding apparatus as a first embodiment of the invention.

With reference to the drawings, several embodiments of the invention will be described below which are adapted for use in grinding opposite surfaces of semiconductor wafers. Throughout the drawings, like parts are designated by like reference numerals.

First Embodiment

FIGS. 1 to 6 show a first embodiment. FIG. 1 shows the overall construction thereof, i.e., of a double side grinding apparatus. The first embodiment is used for work formed with no positioning flat portion. The double side grinding apparatus comprises a vertical spindle double head surface grinding machine 1 and a work rotating device 2 serving as means for rotating work about its own axis and added to the machine. FIGS. 2 to 5 show the rotating device 2 in detail. In the following description of the first embodiment, the left-hand side of FIG. 1 will be referred to as "front," and the right-hand side thereof as "rear." The terms "right" and "left" are used for the apparatus as it is seen from the front rearward.

The grinding machine 1 comprises a horizontal base 3, a bed 4 horizontally secured to the upper surface of the base 3 except at a rear portion thereof, a column 5 horizontally secured to the upper surface of the base 3 at the rear portion and extending upward from the upper surface of the bed 4, upper and lower slides 6, 7 attached to the front side of the column 5, and upper and lower wheel heads 8, 9 secured to the front sides of the respective slides 6, 7. The slides 6, 7 are moved upward and downward along the column 5 independently of each other by unillustrated drive means. Vertical wheel spindles 10, 11 are rotatably supported inside the respective upper and lower wheel heads 8, 9. The upper and lower wheel spindles 10, 11 are in alignment with a common vertical line. A cuplike upper grinding wheel 12 is fixed to the lower end of the upper wheel spindle 10 projecting downward from the upper wheel head 8. A lower grinding wheel 13 identical with the wheel 12 in shape and size is fixed to the upper end of the lower wheel spindle 11 projecting upward from the lower wheel head 9. An annular horizontal lower end face of the upper wheel 12 serves as an upper circular grinding face 12*a*, and an annular horizontal upper end face of the lower wheel 13 as a lower circular grinding face 13*a*. The upper and lower grinding faces 12*a*, 13*a* are parallel and opposed to each other. With the present embodiment, the outer periphery of each wheel 12 (13) coincides with the outer periphery of each grinding face 12*a* (13*a*). At least one of the upper and lower slides 6, 7 moves upward or downward, whereby the upper and lower grinding wheels 12, 13 are moved upward or downward, i.e., axially thereof, relative to each other. Although not shown in detail, the bed 4 is formed with space so as not to interfere with the movement of the lower wheel head 9, etc. The upper and lower wheel spindles 10, 11 are rotated at the same speed in directions opposite to each other by unillustrated drive means, with the result that the upper and lower grinding wheels 12, 13 are rotated at the same speed in directions opposite to each other. For example, the upper grinding wheel 12 is rotated clockwise, and the lower grinding wheel 13 counterclockwise when seen from above. The other portion of the grinding machine 1 can be of the same construction as the known vertical spindle double head surface grinding machine.

The work rotating device 2 rotates thin disklike work (wafer) W about its own axis while supporting the work W horizontally in a grinding position between the upper and lower grinding faces 12*a*, 13*a* so that opposite surfaces a, b of the work W to be worked on face the respective upper and lower grinding faces 12*a*, 13*a*, with the outer periphery of the work W intersecting the outer peripheries of the grinding faces 12*a*, 13*a* and with the center c of the work W positioned inwardly of the grinding faces 12*a*, 13*a*. The rotating device 2 comprises outer periphery guide rollers (radial support rollers) 14, drive rollers (axial support rollers) 15 and holding rollers (axial support rollers) 16, the rollers of each type being three in number. The guide rollers 14 are adapted to contact the outer periphery of the work W at the portion thereof projecting outward from between the grinding wheels 12, 13, providing radial support means for defining the position of the work W radially thereof. The drive rollers 15 are paired with the holding rollers 16. The portion of the work W projecting outward from between the wheels 12, 13 is held at three locations by the holding rollers 16 and the drive rollers 15 from above and below. The drive rollers 15 rotate in pressing contact with the lower surface b of the work W, whereby the work W is rotated. The holding rollers 16 idly rotate in pressing contact with the upper surface a of the work W. The drive rollers 15 and the holding rollers 16 provide axial support means for defining the position of the work W axially thereof. The drive rollers 15 provide drive means for rotating the work W.

Figure 6:
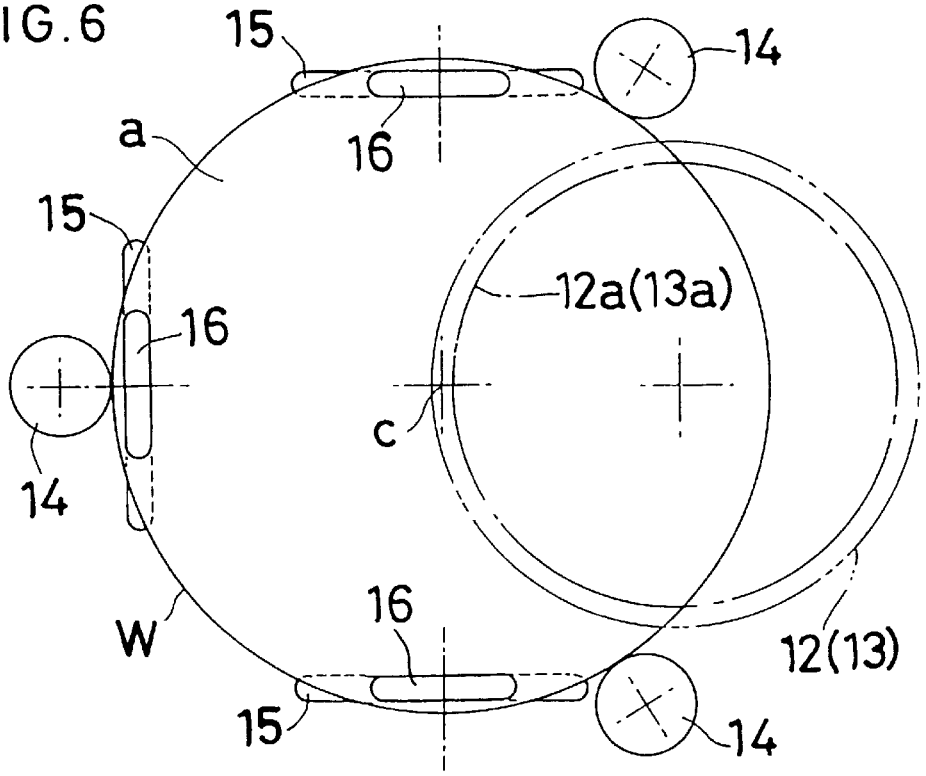
FIG. 6 is a diagram showing the main portion of the device.

FIG. 6 shows the position of the grinding wheels 12, 13, the rollers 14, 15, 16 of the rotating device 2 and the work W supported at the grinding position by the rotating device 2, relative to one another as viewed from above. With the present embodiment, the outside diameter of the wheels 12, 13 is about ¾ of the outside diameter of the work W. The guide rollers 14 are arranged at positions dividing the circumference of the work W into three approximately equal parts. It is desired that the pairs of drive rollers 15 and holding rollers 16 be positioned in closest proximity with the positions dividing the circumference of the work W into three equal parts insofar as the rollers will not interfere with the wheels 12, 13. In view of the relation with the wheels 12, 13, the roller pairs are arranged at three of positions dividing the circumference of the work into four equal parts according to the present embodiment. The outer periphery of the work W supported at the grinding position intersects the outer peripheries of the grinding faces 12*a*, 13*a*, and the center c of the work W is positioned inwardly of the grinding faces 12*a*, 13*a*. In other words, the outer periphery of the work W is partly positioned inside the outer peripheries of the grinding faces 12*a*, 13*a*, and the center c of the work W is positioned between the outer and inner peripheries of each of the grinding faces 12*a*, 13*a*.

An upper support member (first support member) 17 is fastened to the front side of the upper wheel head 8 with bolts 18. The support member 17 has arms 17*a* integral with its lower portion and extending horizontally from the front side and right and left sides thereof. Each of the arms 17*a* has an outer end portion extending vertically downward. The holding roller 16 is mounted on this portion so as to be freely rotatable about a horizontal shaft 19 extending radially of the work W as supported by the rotating device 2. The support member 17 is movable upward and downward along a vertical guide member 20 which is fixed to the front side of the wheel head 8. The support member 17 is formed with vertical slots (not shown) for inserting the respective bolts 18 therethrough. The position of the support member 17, i.e.,of the holding rollers 16, is adjustable with respect to the upward or downward direction by a position adjusting screw 21. With the present embodiment, the lower-end outer peripheral surfaces (pressing contact faces) of the holding rollers 16 adapted for pressing contact with the work surface a are positioned at the same horizontal plane, and the position of the support member 17 with respect to the upward or downward direction is so adjusted that the pressing contact faces will be positioned a small distance (e.g., about 0.05 mm) below the upper grinding face 12*a*. The direction of rotation of each holding roller 16 at its pressing contact face is in match with the circumferential direction of the work W. The support member 17 and the holding rollers 16 are so adapted as not to interfere with the grinding wheel 12.

Fixedly provided on the bed 4 is a horizontal base plate 22 generally channel-shaped when seen from above and having an open rear portion. A guide rod 23 extending upward vertically has its lower end fixed to the upper side of the base plate 22 at each of a plurality of portions, e.g., three portions, i.e., the widthwise midportion in the front and right and left side portions in the rear. A flangelike stopper 23*a* is integrally formed at the upper end of the guide rod 23. The guide rod 23 comprises a hexagon head bolt and is screwed in the base plate 23 and fixed thereto with a lock nut 24. Disposed above the base plate 23 is a lower support member (second support member) 25 generally channel-shaped when seen from above and having an open rear portion. The guide rod 23 is inserted through a guide bore 26 vertically extending through the support member 25 at each of three portions. The support member 25 is movable upward and downward along the guide rods 23. Between the lock nut 24 and the lower surface of the support member 25, a coiled compression spring 27 serving as an elastic body is provided around the rod 23 for biasing the support member 25 upward. The support member 25 is movable between an upper limit position where the upper surface thereof comes into contact with the stopper 23*a* and a lower limit position in which the spring 27 is completely compressed.

The support member 25 is integrally formed with upright walls 25*a*, 25*b* extending vertically upward from its upper side and arranged at three portions, i.e., the widthwise midportion of its front end and at the right and left sides of its rear portion. An electric motor 28 directed rearward is fixed to the front wall 25*a* of the support member 25 on the front side of upper portion thereof. The motor 28 has a drive shaft 29 extending through the wall 25*a* radially of the work W. The drive roller 15 positioned under the front holding roller 16 is fixed to the rear end of the drive shaft 29 extending rearward through the wall 25*a*. A drive motor 28 directed inward is fixed to each rear side wall 25*b* of the support member 25 on the outer side of upper portion thereof. The motor 28 has a drive shaft 29 extending through the wall 25*b* radially of the work W. The drive roller 15 positioned under each of the right and left holding rollers 16 in the rear is fixed to the inner end of the drive shaft 29 extending inward through the wall 25*a*. The three drive rollers 15 are rotated by the respective motors 28 in the same direction (for example, counterclockwise when seen from the motor side). The front guide roller 14 is freely rotatably mounted on a vertical shaft 30 on the top of the front wall 25*a* of the support member 25. This guide roller 14 is positioned immediately in front of the front drive roller 15. The right and left rear walls 25*b* of the support member 25 are slightly projected laterally inward at their upper portion rear ends, and the right and left rear guide rollers 14 are mounted on the tops of these portions each freely rotatably by a vertical shaft 30. These guide rollers 14 are positioned immediately in the rear of the respective right and left rear drive rollers 15. The circle in contact with the three guide rollers 14 has a diameter approximately equal to the outside diameter of the work W or slightly greater (by, for example, about 1 mm). The three guide rollers 14 are positioned at the same level. The upper-end outer peripheral surfaces (pressing contact faces) of the drive rollers 15 adapted for pressing contact with the work surface b are positioned at the same horizontal plane, and are positioned at the midpoints of height of the guide rollers 14. The direction of rotation of each drive roller 15 at the pressing contact face is in match with the circumferential direction of the work W. When moving to the upper limit position, the support member 25 moves the guide rollers 14 and the drive rollers 15 also to the upper limit position. When moving to the lower limit position, the support member 25 moves the guide rollers 14 and the drive rollers 15 also to the lower limit position. The support member 15 is so adapted as not to interfere with the work W. The base plate 22, support member 25, guide rollers 14, drive rollers 15, etc. are also so designed as not to interfere with the wheel head 9, wheels 12, 13, etc.

Although not shown, the grinding apparatus is provided with an autoloader serving as work loading-unloading means and equipped with a robot or the like. The robot has, for example, an arm provided with a suction disk for holding the work W, whereby the work W is automatically loaded onto and unloaded from the rotating device.

When the work W is to be ground, the lower wheel head 9 is fixed in position so that the grinding face 13*a* of the lower grinding wheel 13 is positioned above the pressing contact faces of the drive rollers 15 as located at the lower limit position and is positioned slightly (e.g. about 2 mm) below the pressing contact faces of the drive rollers 15 as located at the upper limit position. The upper wheel head 8 is moved upward or downward.

The grinding operation is performed, for example, in the following manner.

Figure 3:
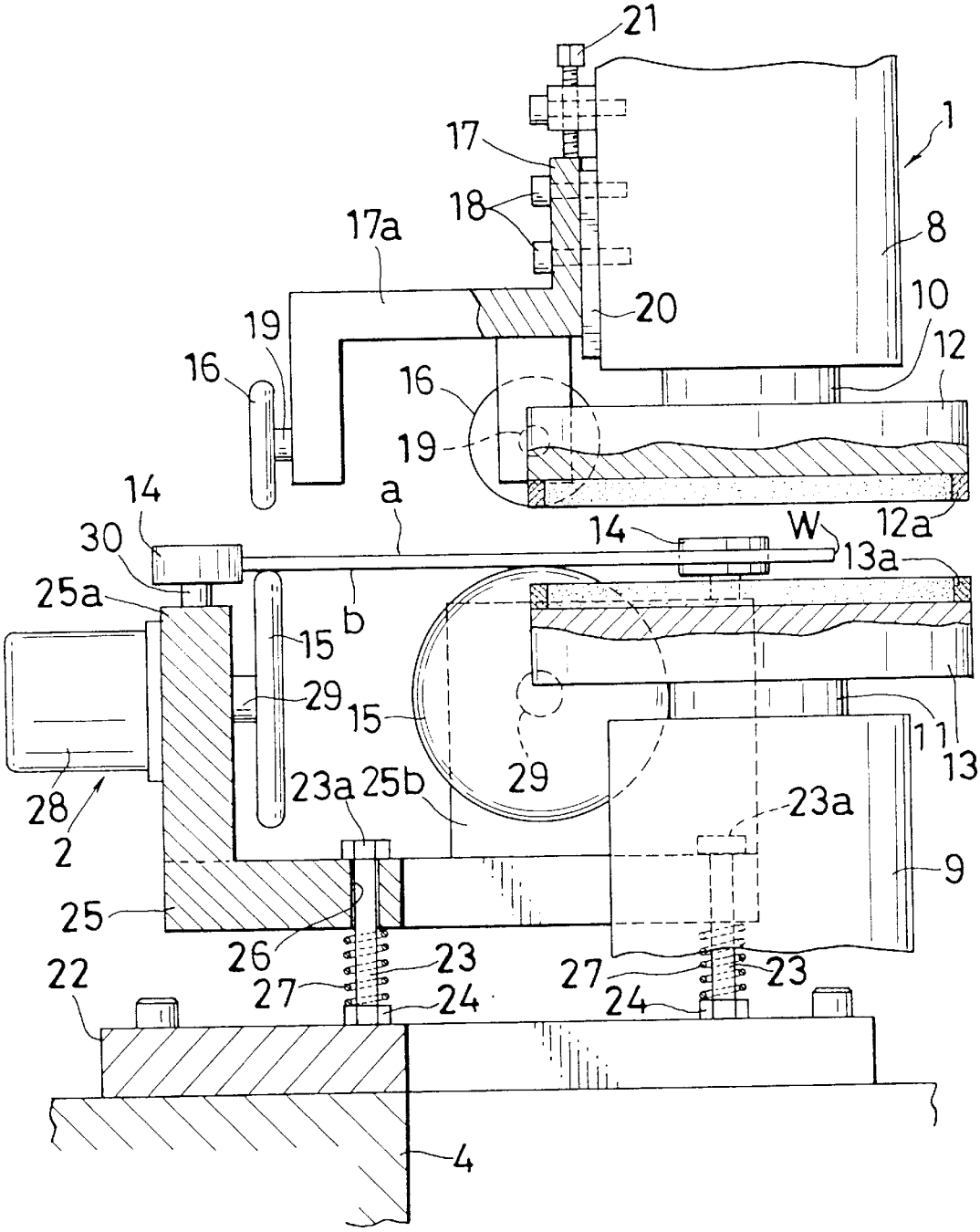
FIG. 3 is a side elevation partly broken away and showing the work rotating device on an enlarged scale.

The upper and lower grinding wheels 12, 13 are always in rotation during the grinding operation. First, with the upper wheel 12 moved to a raised standby position as seen in FIG. 3, the work W is loaded onto the rotating device 2 and fitted into the arrangement of guide rollers 14, as placed on the drive rollers 15 by the autoloader. The work W placed on the drive rollers 15 is positioned a small distance above the grinding face 13*a* of the lower wheel 13 at this time. The drive rollers 15 are at rest.

Figure 4:
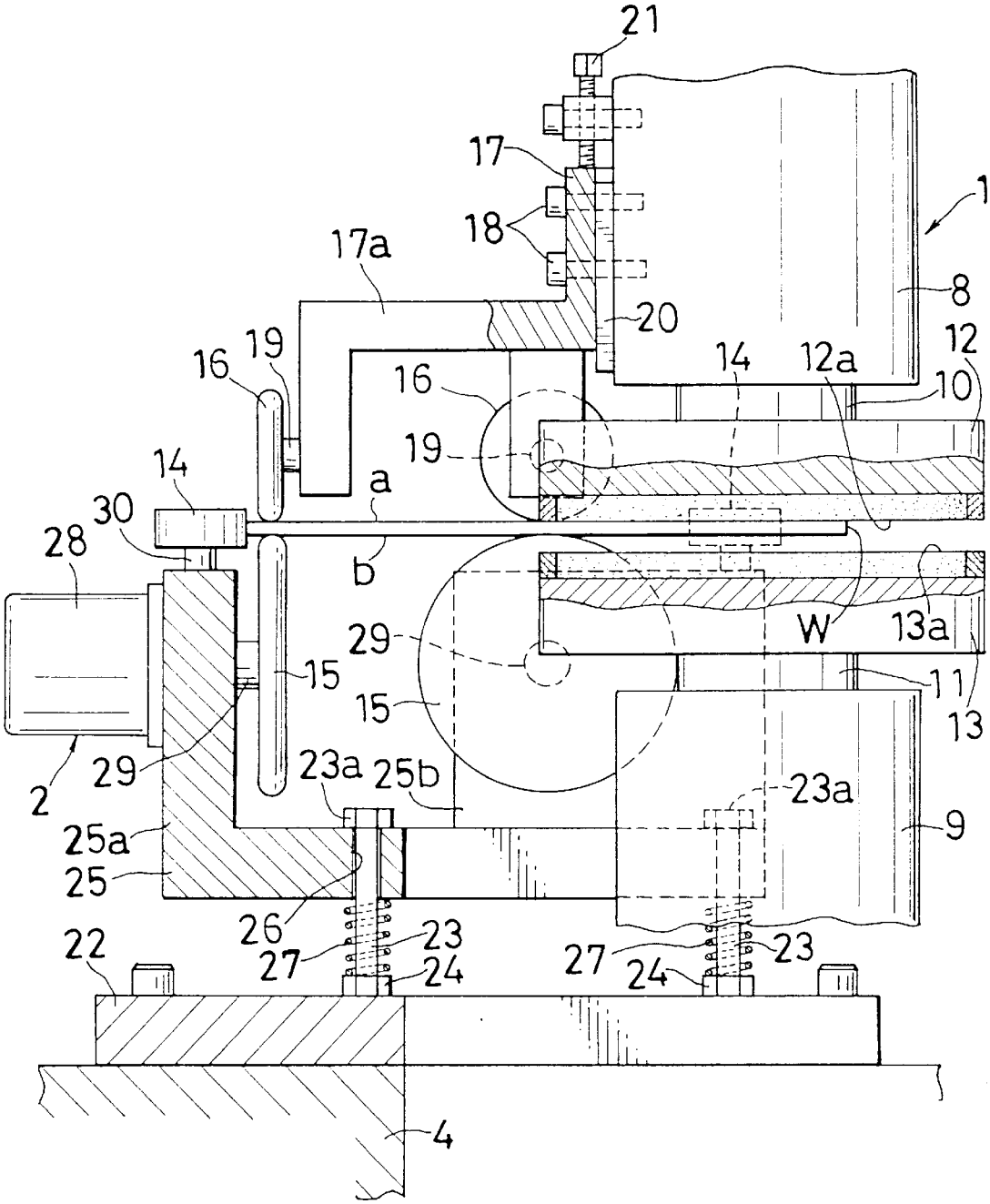
FIG. 4 is a view corresponding to FIG. 3 and showing the device in a different state.

On completion of loading of the work W, the upper wheel 12 is moved down at a relatively high speed along with the holding rollers 16. When the holding rollers 16 are brought close to the upper work surface a, the upper wheel 12 is moved down at a relatively low speed. When the upper wheel 12 is lowered to a predetermined position, the holding rollers 16 come into pressing contact with the upper work surface a, pressing the lower work surface b against the drive rollers 15. The work W is supported at the grinding position by these rollers and guide rollers 14 as shown in FIG. 4. At this time, the rearward portion of the work W is positioned between the upper and lower grinding wheels 12, 13, with the center c of the work W positioned between the inner and outer peripheries of the grinding faces 12*a*, 13*a* at their front portions. With the pressing contact faces of the holding rollers 16 projecting downward beyond the grinding face 12*a* of the upper wheel 12, the grinding face 12*a* is out of contact with the work surface a although the holding rollers 16 are in pressing contact with the work face 1. The drive rollers 15 start to rotate simultaneously with the pressing contact of the rollers 16 with the work surface a. The rotation of the drive rollers 15 rotates the work W, as held in position radially and axially thereof by the rollers 14, 15, 16, in a direction (for example, in a clockwise direction when seen from above) which is determined by the direction of rotation of the rollers 15.

Figure 5:
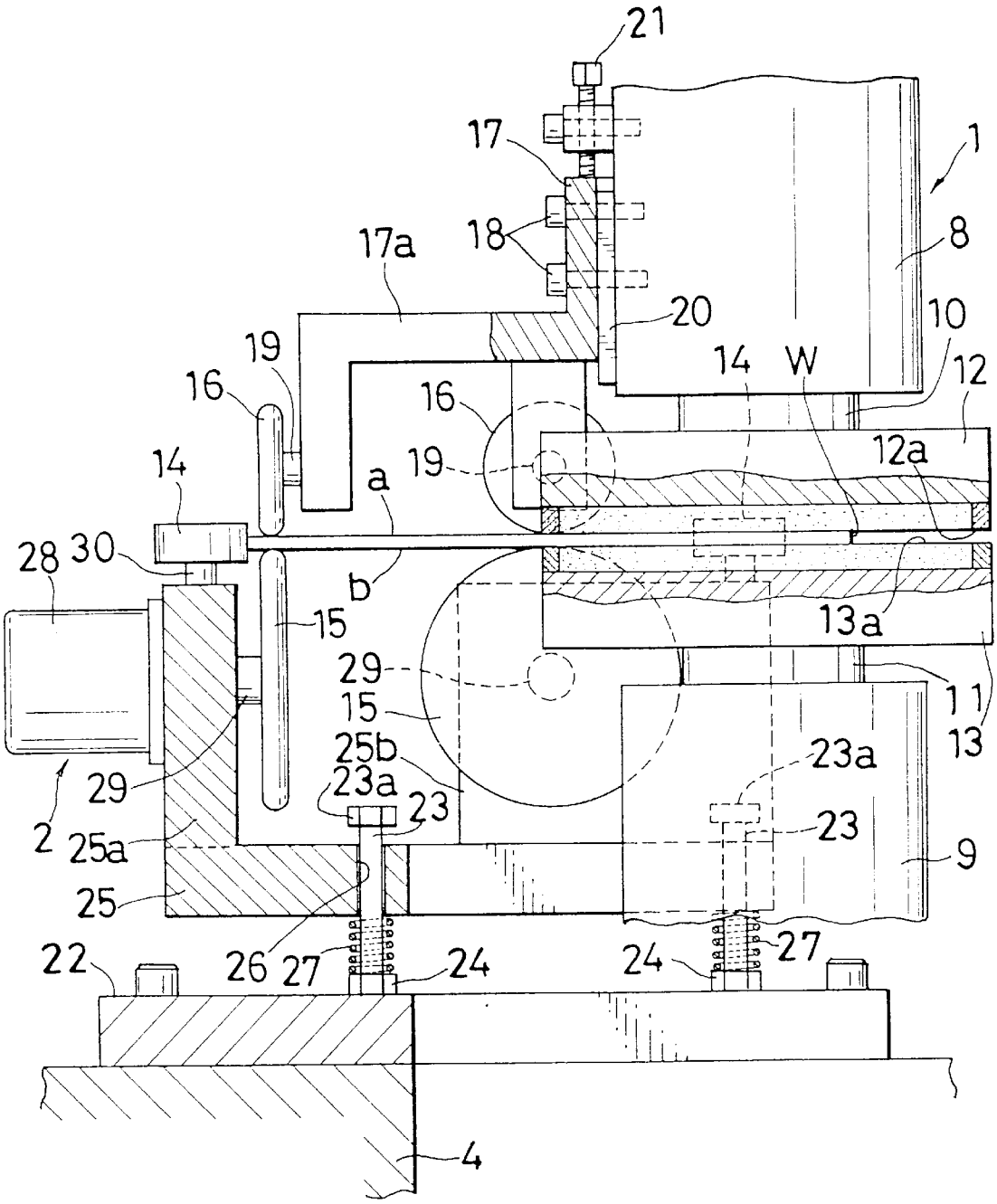
FIG. 5 is a view corresponding to FIG. 3 showing the device in a state further different from that in FIG. 4.

In this state, the upper wheel 12 further descends, whereby the holding rollers 16 are caused to depress the drive rollers 15 through the work W. The lower support member 25 therefore moves down against the elastic force of the springs 27, with the result that the work W also moves down as supported by the rollers 14, 15, 16. When the lower work surface b approaches the grinding face 13*a* of the lower wheel 13, the upper wheel 12 is lowered at a further reduced speed and reaches a predetermined position, whereupon the lower work surface b comes into contact with the grinding face a of the lower wheel 13. The upper wheel 12 slightly descends from this position, whereby the work W is slightly elastically deformed downward at the outer peripheral portion thereof where the holding rollers 16 are in pressing contact with the work W, and the upper wheel grinding face 12*a* comes into contact with the upper work surface a as seen in FIG. 5. The upper wheel 12 is further lowered to a predetermined position which is dependent on the dimension (thickness) to which the work W is to be finished. The wheel 12 is held in this position for a specified period of time. During this period, the rotation of the wheels 12, 13 grinds the work surfaces 12*a*, 13*b* which are in contact with the respective grinding faces 12*a*, 13*a*. The work W rotates about its own axis with the outer periphery thereof intersecting the outer peripheries of the grinding faces 12*a*, 13*a* and with the center c of the work W positioned inwardly of the grinding faces 12*a*, 13*a*, with the result that the entire work surfaces 12*a*, 13*a* move between the grinding faces 12*a*, 13*a* in contact therewith during one turn of rotation of the work W. Consequently, both work surfaces 12*a*, 13*a* are entirely ground at the same time during several turns of rotation of the work W.

After the work W has been ground completely, the upper wheel 12 is moved upward to the standby position at a relatively high speed. When the holding rollers 16 is moved up with the upward movement of the wheel 12, the elastically deformed work W restores itself to the original form, and the grinding face 12*a* of the upper wheel 12 slightly moves upward out of contact with the work surface a. With a further ascent of the upper grinding wheel 12 and the holding rollers 16, the lower support member 25 also follows this movement under the action of the springs 27. The work W as supported by the rollers 14, 15, 16 moves up out of contact with the grinding face 13*a* of the lower wheel 13. The upper wheel 12 and the lower wheel 13 thus leave the work W upon the ascent of the upper wheel 12 and are therefore unlikely mar the completely ground work faces a, b. Upon the work W leaving the grinding face 13*a* of the lower wheel 13, the rotating drive rollers 15 come to a stop, halting the work W in rotation. When the lower support member 25 moves to the upper limit position, the member 25, guide rollers 14 and drive rollers 15 come to rest at this position, so that the holding rollers 16 move up out of contact with the work W, which is in turn left on the drive rollers 15. Upon the upper wheel 12 reaching the standby position, the autoloader delivers the ground work W from the drive rollers 15 and loads the next work onto the rotating device 2, followed by the same grinding operation as above.

The pressing contact faces of the holding rollers 16 may be positioned on the same plane as the grinding faces 12*a* of the upper wheel 12 although projecting downward slightly beyond the grinding face 12*a* in the case of the embodiment described. While the upper and lower grinding wheels 12, 13 are rotated usually at the same speed as in the foregoing embodiment, the two wheels 12, 13 can be rotated for grinding at different speeds as desired as when the work W is to be ground by the upper and roller wheels to different extents. The upper and lower wheels 12, 13 can be rotated in the same direction (e.g., clockwise when seen from above) for grinding. Among the three pairs of rollers 15, 16, all the three rollers 15 arranged at one side are drive rollers according to the foregoing embodiment, whereas at least one of these rollers may be a drive roller. Alternatively at least four pairs of drive rollers 15 and holding rollers 16 may be provided. At least one of these rollers may be a drive roller also in such a case.

Second Embodiment

Figure 7:
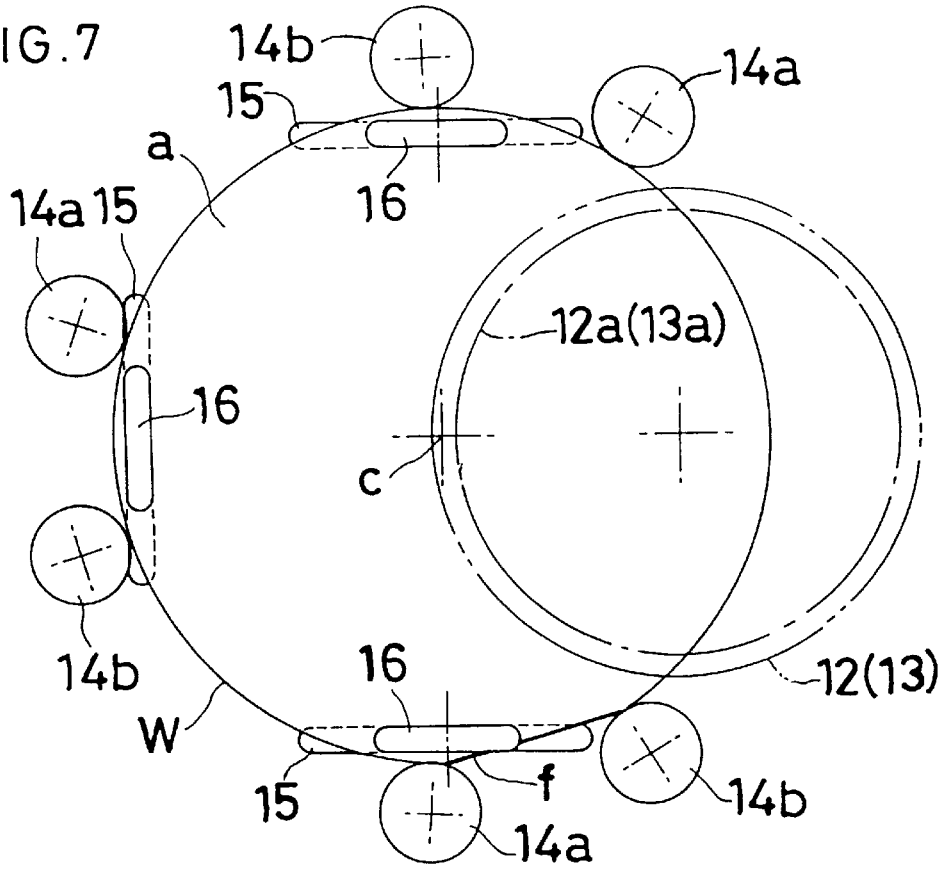
FIG. 7 is a diagram showing the main portion of a work rotating device included in a second embodiment of the invention.

FIG. 7 is a diagram of the main portion of a work rotating device similar to the one shown in FIG. 6 and included in a second embodiment.

The second embodiment is adapted for use with work W which is formed with a positioning flat portion f. The second embodiment differs from the first in the number and arrangement of outer periphery guide rollers (radial support rollers) 14*a*, 14*b*. In the case of the second embodiment, two guide rollers 14*a*, 14*b* are arranged each of three locations around the work W as positioned in place. Preferably, the three locations are in closet proximity with respective positions dividing the circumference of the work W into three equal parts. The spacing between the two rollers 14*a*, 14*b* in each location along the periphery of the work is slightly greater than the circumferential dimension of the flat portion f. This enables the six guide rollers 14*a*, 14*b* to reliably support the work W radially thereof despite the presence of the flat portion f. However, this embodiment is of course usable also for grinding work having no positioning flat portion.

The grinding apparatus according to the second embodiment can be of the same construction as the apparatus of the first embodiment.

Although the first and second embodiments are vertical spindle double side grinding apparatus wherein the grinding wheels have a vertical axis, the same construction as above can be so modified that the grinding wheels have a horizontal spindle with a horizontal axis.

Third Embodiment

Figure 8:
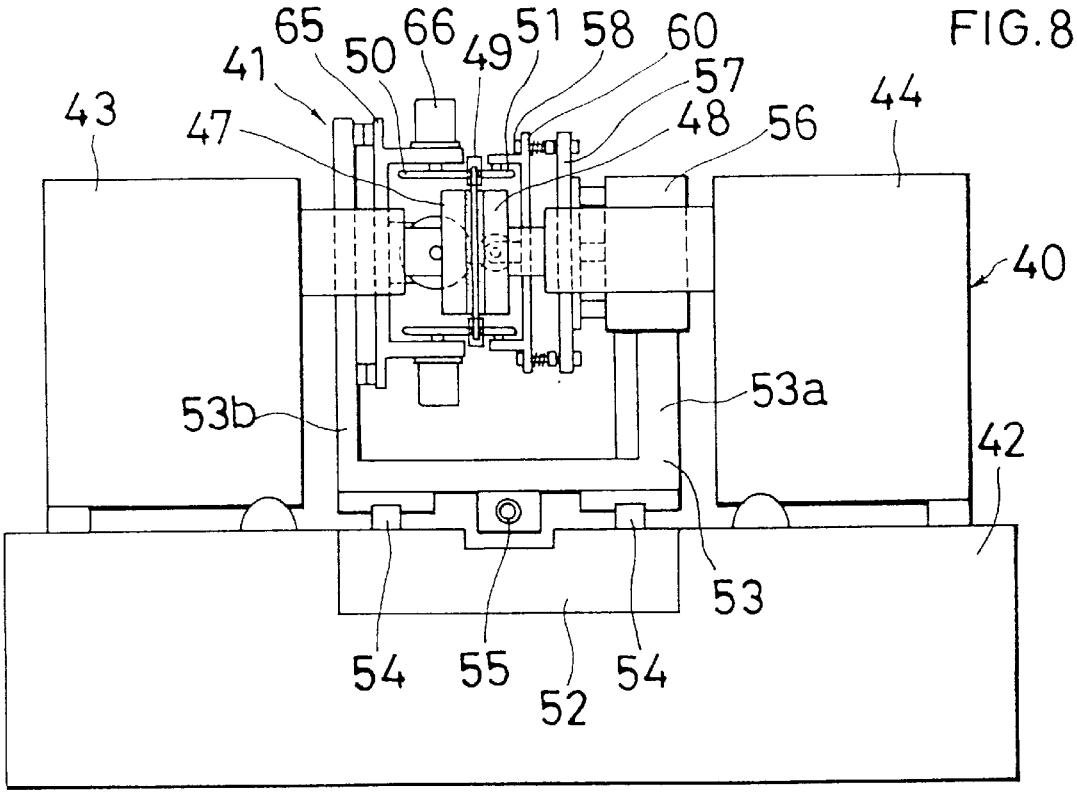
FIG. 8 is a front view schematically showing a grinding apparatus as a third embodiment of the invention.
Figure 2:
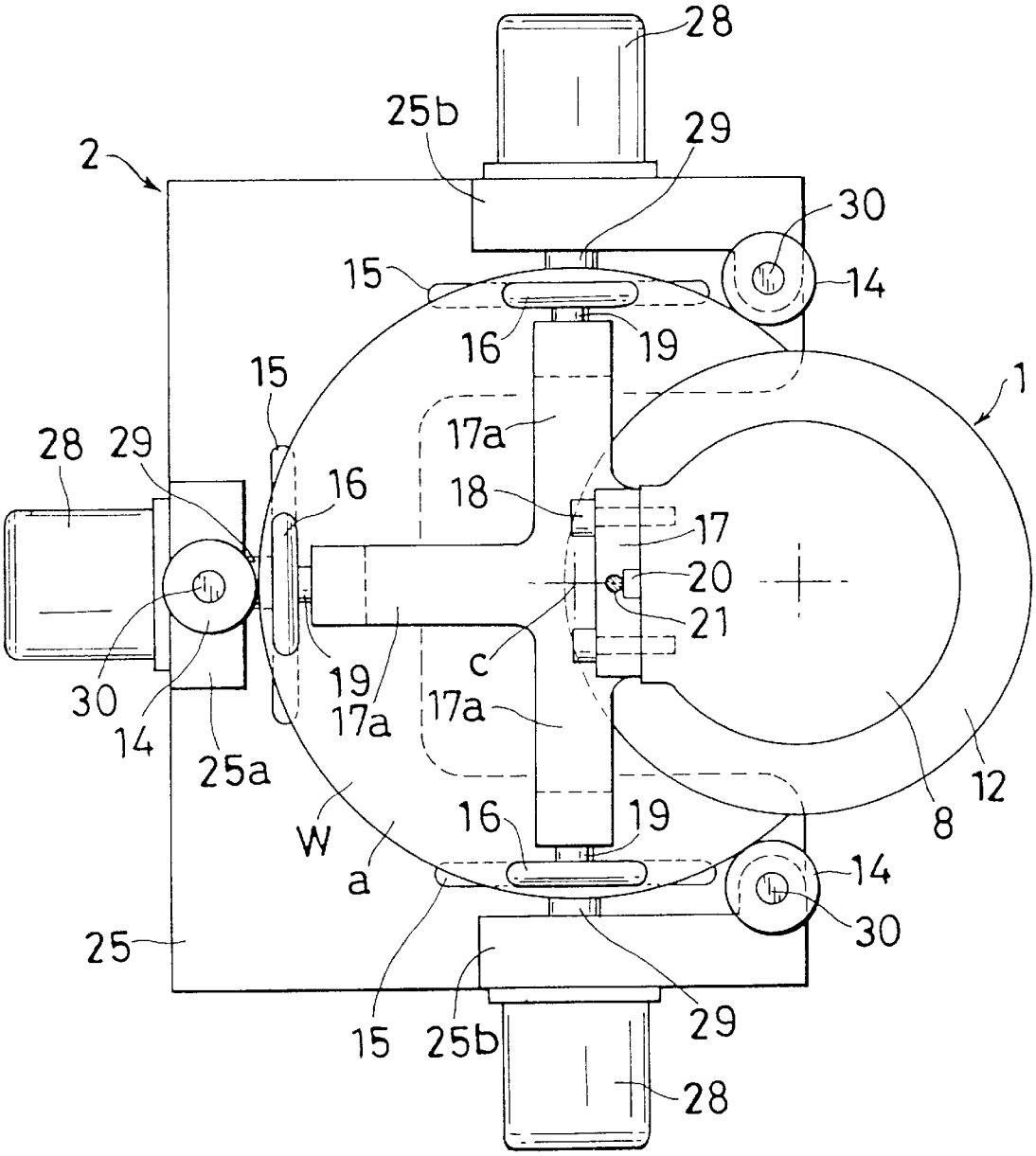
FIG. 2 is a plan view showing on an enlarged scale a work rotating device included in the first embodiment.
Figure 9:
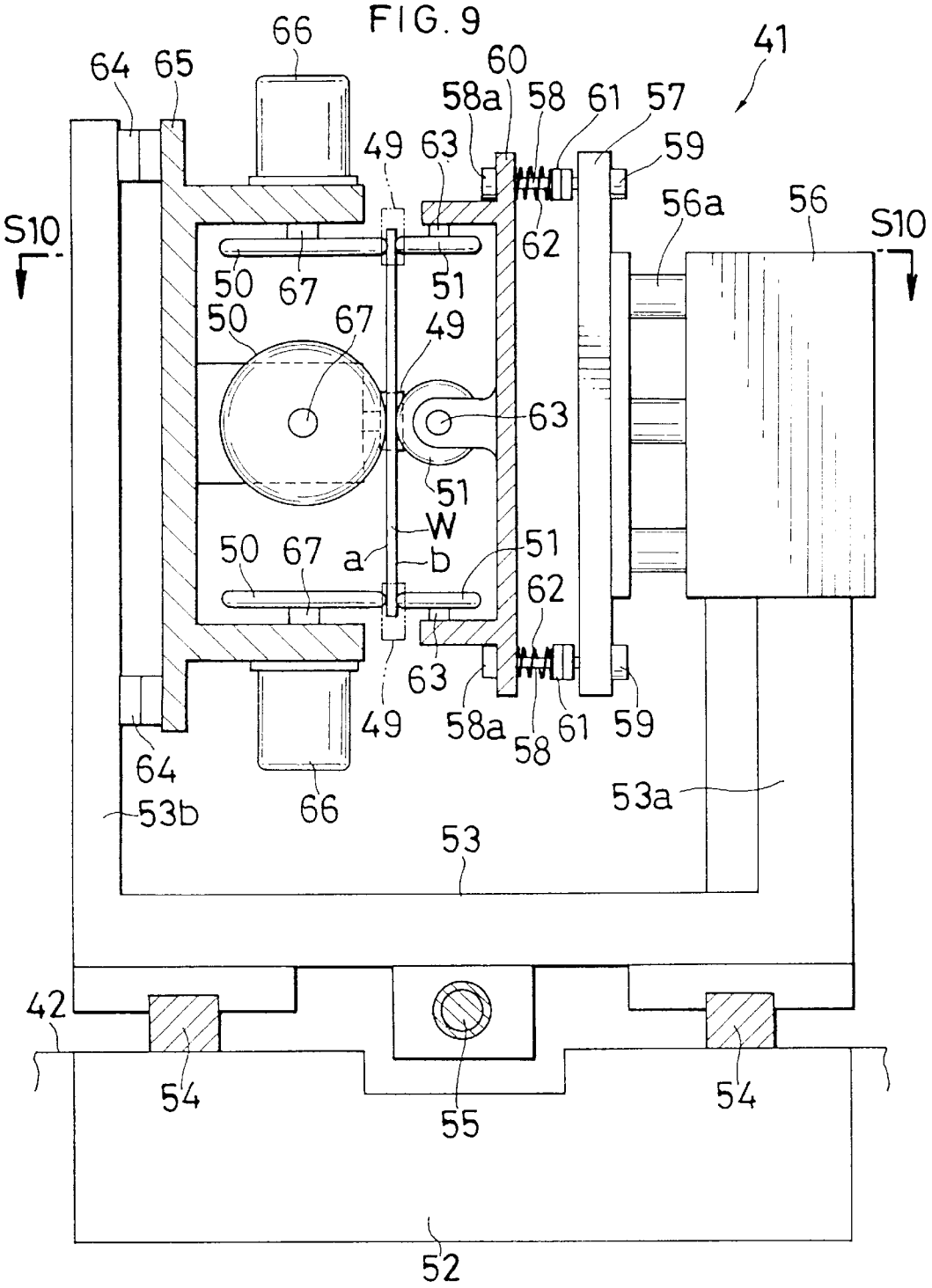
FIG. 9 is a front view partly broken away and showing on an enlarged scale a work rotating device included in the third embodiment.
Figure 10:
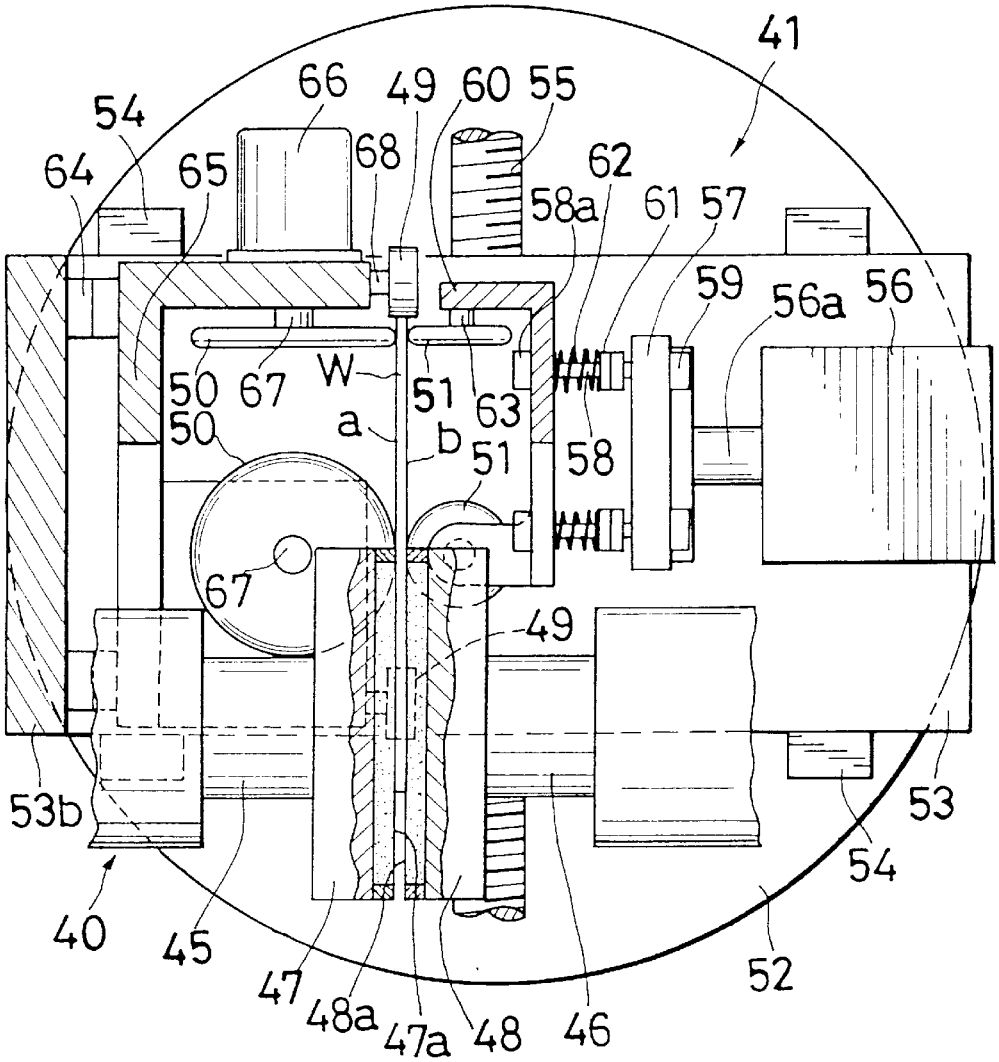
FIG. 10 is a view in section taken along the line S10—S10 in FIG. 9.

FIGS. 8 to 10 show a third embodiment. FIG. 8 shows the overall construction of a double side grinding apparatus. The third embodiment is adapted for use with work W having no positioning flat portion. The apparatus comprises a horizontal spindle double head surface grinding machine 40 and a work rotating device 41 added thereto. The rotating device 41 is shown in greater detail in FIGS. 9 and 10. In the following description of the third embodiment, the front side of the plane of FIG. 8 will be referred to as the "front", and the rear side thereof as the "rear," and the terms "right" and "left" will be used for the apparatus as it is seen from the front rearward. Thus, the right- and left-hand sides of FIG. 8 will be referred to respectively as "right" and "left."

The grinding machine 40 comprises a horizontal bed 42, and left and right wheel heads 43, 44 mounted on the bed 42. Although not shown in detail, the wheel heads 43, 44 are so fixed to the bed 42 as to be adjustable independently of each other in angle with respect to the front-rear direction and upward-downward direction. Horizontal wheel spindles 45, 46 are rotatably supported by the respective heads 43, 45 inside thereof. The wheel spindles 45, 46 are in alignment with a common horizontal line extending from left to right, and are movable rightward and leftward relative to the respective heads 43, 44. The spindle 45 projecting rightward from the left wheel head 43 fixedly carries at its outer end a cuplike left grinding wheel 47. A right grinding wheel 48 identical in shape and size is fixed to the outer end of the spindle 46 projecting leftward from the right wheel head 44. An annular vertical right end face of the left wheel 47 and an annular vertical left end face of the right wheel 48 provide circular grinding faces 47*a*, 48*a*, respectively. These grinding faces 47*a*, 48*a* are parallel and opposed to each other. The outer periphery of each grinding wheel 47 (48) coincides with the outer periphery of the grinding face 47*a* (48*a*) also in the case of this embodiment. At least one of the wheel spindles 45, 46 moves rightward or leftward, whereby the left or right grinding wheels 47, 48 are moved rightward or leftward, i.e., axially thereof, relative to each other. The left and right wheels 47, 48 are rotated at the same speed in directions opposite to each other. The other portion of the grinding machine 40 can be of the same construction as the known horizontal spindle double head surface grinding machine.

As is the case with the first embodiment, the work rotating device 41 comprises outer periphery guide rollers (radial support rollers) 49, drive rollers (axial support rollers) 50 and holding rollers 51. The rollers of each type are three in number. When seen from the right or left, the position of the wheels 47, 48, the rollers 49, 50, 51 of the rotating device 41 and the work W as supported at the grinding position relative to one another is the same as in the case of the first embodiment shown in FIG. 6.

A base plate 52 in the form of a horizontal disk is mounted on the upper side of the bed 42 so as to be rotatable about a vertical axis.

A slide member 53 generally U-shaped when seen from the front is mounted on guide rails 54 provided on the upper side of the base plate 52 and extending horizontally from the front rearward so as to be slidable on the rails. The slide member 53 is connected to a ball screw 55 extending horizontally in the front-rear direction. When rotated by an unillustrated electric motor or the like, the ball screw 55 moves the slide member 53 forward or rearward.

A thin cylinder 56 having a guide is provided on the upper portion of a right upward projection 53*a* of the slide member 53, and has actuators 56*a* projecting horizontally leftward. A movable member 57 in the form of a vertical plate is fixed to the left ends of the actuators 56*a*. The movable member 57 is moved between a standby position at right and an operating position at left by the operation of the cylinder 56. Guide rods 58 extending horizontally leftward are fixed at their right ends to the movable member 57. Each guide rod 58 is integrally formed with a flangelike stopper 58*a* at its left end. The guide rod 58 comprises a hexagon head bolt, and is inserted through the movable plate 57 and fixed thereto with a lock nut 59. Disposed at the left side of the movable plate 57 is a right support member (first support member) 60, which is attached to left portions of the guide rods 58 so as to be movable rightward or leftward along the rods. A spring force adjusting nut 61 is screwed on each guide rod 58 at a right portion thereof at the left side of the plate 57. A coiled compression spring 62 serving as an elastic body is provided around the guide rod 58 between the nut 61 and the support member 60, whereby the support member 60 is biased leftward. The support member 60 is movable between a left limit position where it is in contact with the stopper 58*a* and a right limit position where the member 60 compresses the spring 62 to the full extent. As is the case with the first embodiment, each of the holding roller 51 is attached to the support member 60 so as to be freely rotatable about a shaft 63 extending radially of the work W as supported by the rotating device 41. The holding rollers 51 are arranged at the rear side of the work W and upper and lower parts of its front portion, respectively.

The slide member 53 has a left upward projection 53*b*, to the right side of which is fixed a left support member (second support member) 65 with spacers 64 interposed therebetween. As in the case of the first embodiment, electric motors 66 are fixed to the support member 65. Each motor 66 has a drive shaft 67 extending radially of the work W and fixedly carrying the drive roller 50 thereon. In corresponding relation with the holding rollers 51, the drive rollers 50 are arranged at the rear side of the work W and the upper and lower parts of its front portion, respectively. Further as is the case with the first embodiment, the guide rollers 49 are fixed to the support member 65 so as to be freely rotatable each about a horizontal shaft 68 extending in the right-left direction.

The position of the rollers 49, 50, 51 with respect to the forward or rearward direction, i.e., the position of the work W to be supported by the rotating device 41 with respect to this direction, is adjusted by moving the slide member 53 along the guide rials 54. The base 52, when rotated about its axis, adjusts the inclination, about a vertical axis, of the left-end outer peripheral surface (pressing contact face) of each holding roller 51 in pressing contact with the surface b of the work W to be worked on, as well as of the right-end outer peripheral surface (pressing contact face) of each drive roller 50 in pressing contact with the surface a of the work W to be worked on. The inclination of the pressing contact face of the drive roller 50 is adjustable also by varying the thickness of the spacers 64. Usually, the pressing contact face of the holding roller 51 and that of the drive roller 50 are adjusted in inclination so as to be vertical faces parallel to the grinding faces 47*a*, 48*a*. A major portion of the rotating device 41 is positioned to the rear of the wheel spindles 45, 46 and the grinding wheels 47, 48, and the upper and lower portions of the device 41 are located respectively above and below the spindles 45, 46 and the wheels 47, 48. Thus, the rotating device 41 is adapted not to interfere with the spindles 45, 46, wheels 47, 48, etc.

The work W is ground, for example, in the following manner.

The left and right grinding wheels 47, 48 are always in rotation during the grinding operation also in this case. When the operation is to be started, the wheels 47, 48 are away from each other in their standby positions at left and right, with the movable member 57 in its standby position at right. Accordingly, the right support member 60 is in the left limit position relative to the movable member 57, and the holding rollers 50 are a considerably distance rightwardly away from the drive rollers 50. At this time, the drive rollers 50 are held out of rotation. In this state, the work W is loaded onto the rotating device 41 and fitted in the arrangement of the guide rollers 49, in contact with the pressing contact faces of the drive rollers 50 by an autoloader. With the work W thus positioned and supported by the robot, the movable member 57 is moved to an operating position at left. The leftward movement of the member 57 also moves the holding rollers 51 leftward into contact with the work surfaces b. After the holding rollers 51 come into contact with the work W, the movable member 57 alone moves to the operating position against the elastic force of the springs 62, whereby the springs 62 are compressed. The holding rollers 51 are pressed into contact with the work surface b, and the drive rollers 50 with the work surface a with the force of the springs 62. Consequently, the work W is supported at the grinding position, with the front portion of the work W positioned between the opposed wheels 47, 48 and with the center of the work W positioned between the outer and inner peripheries of the grinding faces 47*a*, 48*a* at their rear portions. When the work W is supported at the grinding position, the robot leaves the work W.

On completion of loading of the work W, the drive rollers 50 start to rotate. The work W as restrained in position by the rollers 49, 50, 51 radially and axially thereof is rotated by the rotation of the drive rollers 50 in a direction (e.g., clockwise when seen from the right) which is dependent on the direction of rotation of the drive rollers 50. At the same time, the wheels 47, 48 are moved toward each other, bringing the grinding faces 47*a*, 48*a* into contact with the respective work surfaces a, b opposed thereto. The wheels 47, 48 move to a predetermined position dependent on the dimension to which the work W is to be finished and are held in this position for a specified period of time, whereby the opposite work surfaces a, b are entirely ground at the same time. When required, the ball screw 55 is reciprocatingly driven during grinding to thereby reciprocatingly move the work W forward and rearward, i.e., in directions parallel to the grinding faces 47*a*, 48*a* and along a phantom line through the center of the work W and the axis of the wheels 47, 48. This reciprocating movement is effected within such limits that the center of the work W is positioned always inside the grinding faces 47*a*, 48*a*. The stroke length of this movement is, for example, about 5 mm. The reciprocating movement thus effected improves the flatness and surface roughness of the work W especially at its central portion.

When the work W is completely ground, the wheels 47, 48 leave the work W and further move to the left and right standby positions. When the work W is released from the wheels 47, 48, the drive rollers 50 are brought out of rotation to stop the rotation of the work W. With the work W at rest and with the wheels 47, 48 brought to their standby positions, the work W is supported by the robot. The movable member 57 is moved to its standby position at right. This returns the right support member 60 to the left limit position relative to the movable member 57, moving the holding rollers 51 rightward away from the work W. After the holding rollers 51 are moved rightward, the robot unloads the ground work W and loads the next work onto the rotating device 41, followed by the same grinding operation as above.

Although the work W is reciprocatingly moved preferably in directions along a line through the center of the work W and the axis of the wheels 47, 48 as described above or in directions approximate thereto, the work may be reciprocatingly moved in parallel to the grinding faces 47*a*, 48*a* in other directions.

The double side grinding apparatus of the third embodiment can be provided with six outer periphery guide rollers as in the second embodiment shown in FIG. 7. The apparatus is then usable for grinding work having a positioning flat portion.

While the third embodiment is a horizontal spindle double side grinding apparatus, a vertical spindle apparatus can be provided by a construction similar to the above.

Fourth Embodiment

Figure 11:
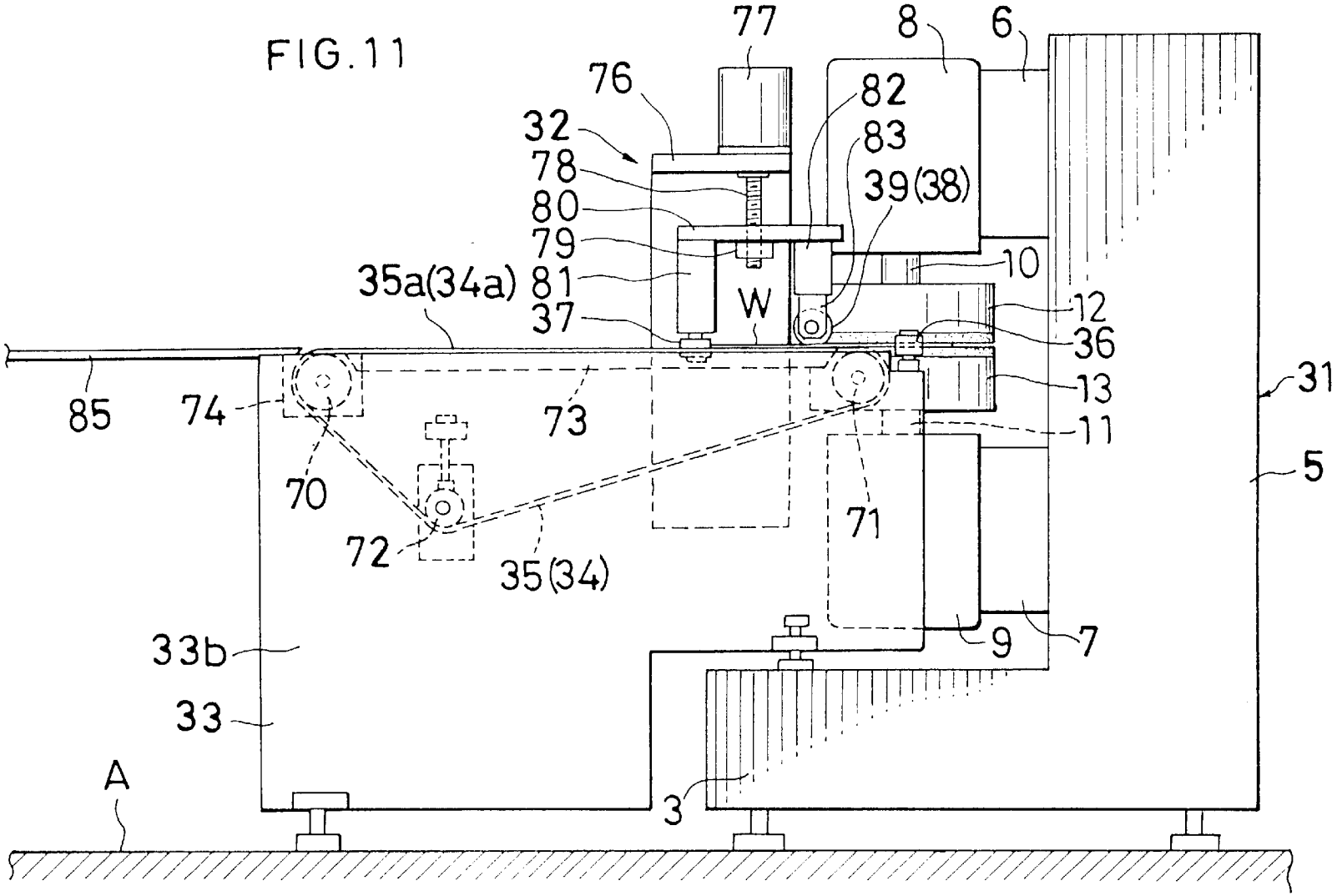
FIG. 11 a side elevation schematically showing a double side grinding apparatus as a fourth embodiment of the invention.
Figure 12:
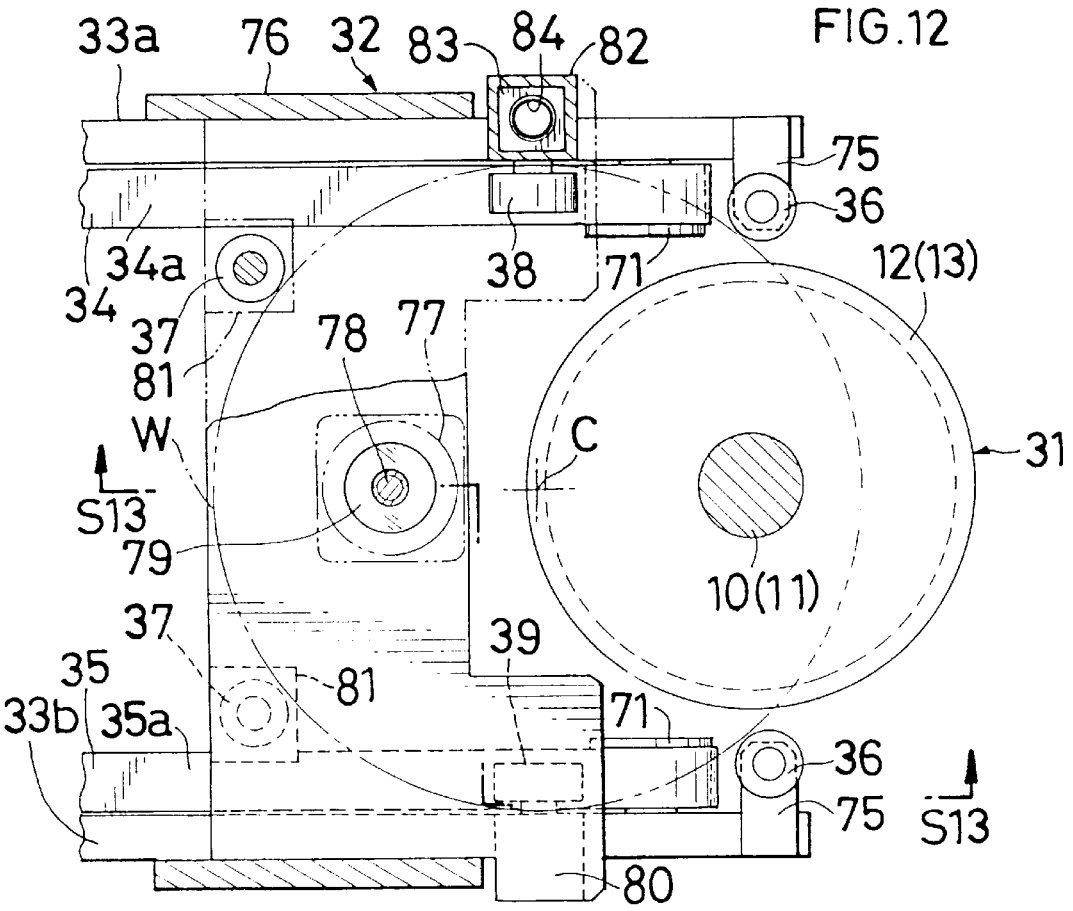
FIG. 12 is a view in horizontal section and showing on an enlarged scale the main portion of a work rotating device included in fourth embodiment.
Figure 13:
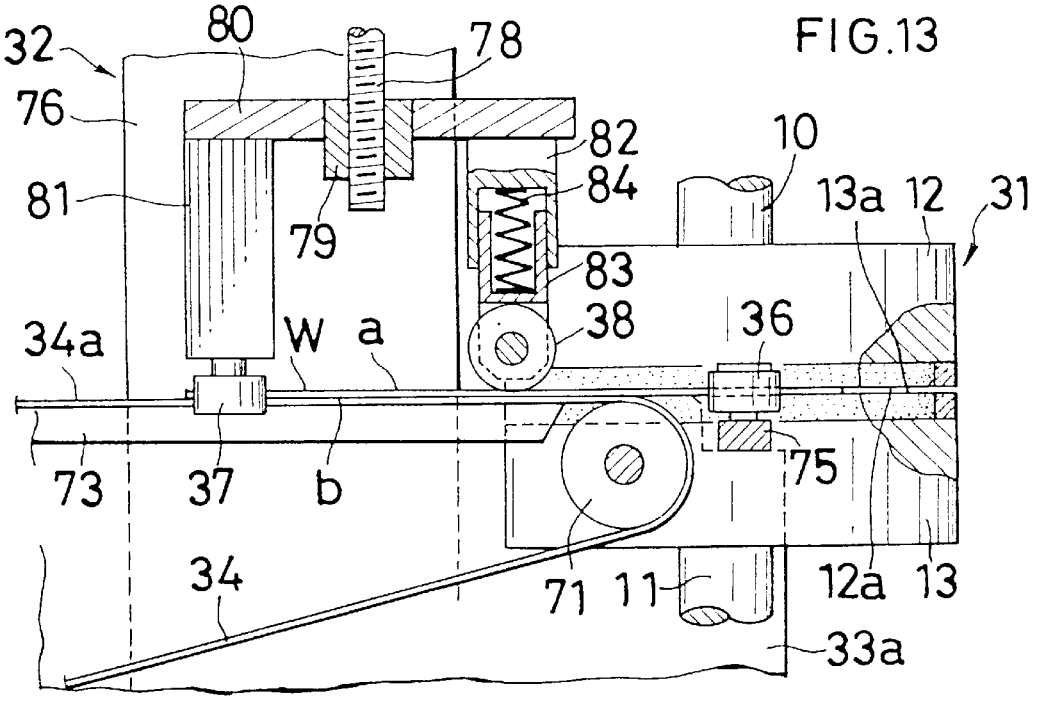
FIG. 13 is a view in section taken along the line S13—S13 in FIG. 12.

FIGS. 11 to 13 show a fourth embodiment. FIG. 11 shows the overall construction of a double side grinding apparatus. The fourth embodiment is adapted for use with work having no positioning flat portion. The apparatus comprises a vertical spindle double head surface grinding machine 31, and a work rotating device 32 added thereto. The rotating device is shown in greater detail in FIGS. 12 and 13. In the following description of this embodiment, the left-hand side of FIG. 11 will be referred to as "front," and the right-hand side thereof as "rear." The terms "right" and "left" are used for the apparatus as it is seen from the front rearward.

The grinding machine 31 corresponds to the grinding machine 1 of the first embodiment from which the bed 4 is removed, and has a bed 3 fixed to a floor A.

The work rotating device 32 is adapted to rotate the work W about its own axis as supported horizontally at a grinding position as in the first embodiment, and to load the work to the grinding position and unload the work W therefrom. The device has a fixed base frame 33 provided over the front portion of base 3 of the machine 31 and the portion of the floor A in front thereof. The base frame 33 has left and right side plates 33*a*, 33*b* which are vertical and elongated in the front-rear (i.e., longitudinal) direction. The side plates 33*a*, 33*b* are interconnected at their lower portions and adapted not to interfere with the wheel heads 8, 9 and wheels 12, 13.

The rotating device 32 comprises a pair of right and left endless drive belts 34, 35 extending in the longitudinal direction, four guide rollers (radial support rollers) 36, 37 each rotatable about a vertical shaft, and a pair of right and left holding rollers (axial support rollers) 38, 39 each rotatable about a horizontal shaft in the right-left (i.e., transverse) direction.

Each of the side plates 33*a*, 33*b* of the base frame 33 is provided on the inner side thereof with a drive pulley 70, driven pulley 71 and tension pulley 72, each of which is rotatable about a transverse horizontal shaft. The belt 34 (35) is reeved around these pulleys. Each of the belts 34, 35 is, for example, a flat belt of rubber. The drive pulley 70 is disposed at a front upper portion of the side plate 33*a* (33*b*), the driven pulley 71 at a rear upper portion of the side plate 33*a* (33*b*), and the tension pulley 72 at a longitudinally intermediate lower portion of the plate. Between the drive pulley 70 and the driven pulley 71, the belt 34 (35) extends generally horizontally longitudinally of the device, and this portion provides a work support portion 34*a* (35*a*) for supporting with its upper side the work W in contact therewith. Each side plate 33*a* (33*b*) is provided on the inner side thereof with a substantially horizontal guide member 73 for guiding the work support portion 34*a* (35*a*) of the belt 34 (35) by supporting the portion from below. The drive pulleys 70 are driven by respective electric motors 74. The driving direction of each of the belts 34, 35 can be changed independently of the other by controlling the direction of rotation of the motors 74 individually. In connection with the belts 34, 35, the driving direction in which the work support portions 34*a*, 35*a* are moved rearward will be referred to as the "loading direction," and the driving direction in which these portions 34*a*, 35*a* are moved forward as the "unloading direction." The state in which both belts 34, 35 are driven in the loading direction will be referred to as the "work loading state," the state in which both belts 34, 35 are driven in the unloading direction as the "work unloading state," and the state in which one of the belts 34, 35 is driven in the loading direction with the other driven in the unloading direction as the "work rotating state."

The guide rollers 36, 37 are arranged in two pairs respectively at the front and rear of a rearward portion of the base frame 33, symmetrically at right and left. The rear two rollers are fixed guide rollers 36, and the front two rollers are movable guide rollers 37. Each of the side plates 33*a*, 33*b* is fixedly provided with a support member 75 horizontally projecting from the upper rear end portion thereof inward transversely of the device. The fixed guide roller 36 is rotatably mounted on the inner end of the member 75. The fixed guide roller 36 is positioned immediately in the rear of the work support portion 34*a* (35*a*) of the corresponding belt 34 (35). The upper surface of the work support portion 34*a* (35*a*) is positioned at an intermediate portion of height of the outer periphery of the fixed guide roller 36. A gate frame 76 interconnects the opposed side plates 33*a*, 33*b* in a straddling manner at the portions thereof corresponding to rear portions of the belts 34, 35. An electric motor 77 directed downward is fixedly mounted on the horizontal top portion of the frame 76 at the transverse middle thereof, with the lower end of the motor inserted through the top portion. A lift member 80 is suspended from, and attached by a nut 79 to, a vertical feed screw 78 which is driven by the motor 77. The lift member 80 is in the form of a horizontal plate and has right and left side portions which are guided by the respective vertical side portions of the frame 76 so as not to rotate about a vertical axis. The lift member 80 is movable upward and downward within predetermined limits by driving the motor 77. The lift member 80 is fixedly provided, symmetrically at right and left, with a pair of support members 81 extending vertically downward from the front portion thereof. The movable guide roller 37 is rotatably attached to the lower end of each support member 81. The lift member 80 is fixedly provided, symmetrically at right and left, with a pair of guide members 82 extending vertically downward from the rear portion thereof and in the form of a square tube with a lower opening. A support member 83 in the form of a vertical square tube with an open upper portion is slidably fitted at its upper portion in each guide member 82. The support member 83 is movable upward and downward along the guide member 82 within predetermined limits. The holding roller 38 (39) is rotatably attached to the lower end of the support member 83. Disposed in the hollow portion of the guide member 82 and the support member 83 is a coiled compression spring 84 serving as an elastic member for biasing the support member 83 and the holding roller 38 (39) downward. With reference to FIG. 13, the descent of the lift member 80 to a lower limit position brings down the movable guide rollers 37 and the holding rollers 38, 39 to a lower limit position as an operating position. The upper surfaces of work support portions 34*a*, 35*a* of the belts 34, 35 are positioned at an intermediate portion of outer peripheries of the movable guide rollers 37 in the operating position. The holding rollers 38, 39 lowered to the operating position are pressed by the elastic force of the springs 84 into contact with the work support portions 34*a*, 35*a* of the belts 34, 35 supported by the rear portion upper surfaces of the guide members 73. The ascent of the lift member 80 to an upper limit position raises the movable guide rollers 37 and the holding rollers 38, 39 to an upper limit position providing a standby position. At this time, the lowest portions of the movable guide rollers 38 and the lowest portions of the holding rollers 38, 39 which are brought to the lowermost position relative to the guide members 82 by the springs 84 are at a considerable distance upward from the upper surfaces of the work support portions 34*a*, 35*a* of the belts 34, 35.

The rear portions of the belts 34, 35, the fixed guide rollers 36 and the holding rollers 38, 39, although positioned near the wheels 12, 13, are arranged as transversely spaced apart by a suitable distance so as not to interfere with the wheels 12, 13.

The four guide rollers 36, 37 provide radial support means for defining the position of the work W radially thereof. The opposite belts 34, 35 and the holding rollers 38, 39 provide axial support means for defining the position of the work W axially thereof. The belts 34, 35 provide drive means for rotating the work W.

With the present embodiment, the outside diameter of the grinding wheels 12, 13 is about 70% of the outside diameter of the work W. The center c of the work W as supported at the grinding position is positioned between the outer and inner peripheries of the grinding faces 12*a*, 13*a* at the front portions thereof.

Although not shown, the grinding apparatus is provided with a work loading-unloading device equipped, for example, with a loading-unloading conveyor 85.

The work W is ground, for example, by the following operation.

The upper and lower grinding wheels 12, 13 are always in rotation during the grinding operation. When the operation is to be started, the upper and lower wheels 12, 13 are vertically spaced apart at upper and lower standby positions, the movable guide rollers 37 and holding rollers 38, 39 are at the upper-limit standby position, and the belts 34, 35 are at rest. In this state, the work W is moved rearward by the conveyor 85 and loaded onto the portions of the belts 34, 35 to the front of the work support portions 34*a*, 35*a*. The work W as loaded is detected, for example, by an unillustrated sensor, whereupon the conveyor 85 is halted. The belts 34, 35 are driven in the loading direction and brought into the work loading state to move the work W rearward as placed on the work support portions 34*a*, 35*a*. When the work W is brought to the grinding position, rear two portions of the work come into contact with the fixed guide rollers 36, whereby the work W is stopped in position. The contact of the work W with the fixed guide rollers 36 is detected by an unillustrated sensor or the like, whereupon the belts 34, 35 come to a stop, followed by the descent of the movable guide rollers 37 and the holding rollers 38, 39 to the lower-limit operating position. This movement brings the movable guide rollers 37 into contact with the outer periphery of the work W at two front portions thereof or positions the rollers 37 in the vicinity of these portions, while bringing the holding rollers 38, 39 into pressing contact with the upper surface a of the work W placed on the work support portions 34*a*, 35*a* of the belts 34, 35, whereby the work W is supported at the grinding position racially and axially thereof. With the work W thus supported at the grinding position, the rearward portion of the work W is positioned between the upper and lower grinding wheels 12, 13, with the center c of the work W positioned between the outer and inner peripheries of the grinding faces 12*a*, 13*a* at their front portions as seen in FIG. 12.

With the movable guide rollers 37 and the holding rollers 38, 39 lowered to the operating position, the left and right belts 34, 35 are driven in directions opposite to each other and brought into the work rotating state. The travel of the belts 34, 35 in the opposite directions moves the work support portions 34*a*, 35*a* thereof in directions opposite to each other longitudinally of the apparatus, and the right and left side portions of the work W are driven in the same direction circumferentially thereof owing to a frictional force acting between the work and the belts 34, 35. Thus, the work W is rotated approximately about its own axis, i.e., the center c thereof, at the grinding position.

With the start of rotation of the work W, the wheels 12, 13 are moved toward each other, bringing the grinding faces 12*a*, 13*a* into contact with the corresponding work faces a, b, respectively. The wheels 12, 13 are moved to respective positions predetermined in accordance with the dimension to which the work W is to be finished, and held in the positions for a specified period of time. Consequently, both work surfaces a, b are entirely ground at the same time.

When the work W is ground completely, the wheels 12, 13 leave the work W and move to the respective upper and lower standby positions. Upon the wheels 12, 13 leaving the work W, the belts 34, 35 come to a halt to discontinue the rotation of the work W, whereupon the movable guide rollers 37 and the holding rollers 38, 39 rise to the standby position, and the belts 34, 35 are driven in the unloading direction and brought into the work unloading state. The work W is therefore moved forward as placed on the work support portions 34*a*, 35*a* and transferred onto the conveyor 85. When the work W is transferred to the conveyor 85, the belts 34, 35 stop, and the conveyor 85 is driven forward to deliver the work W forward. The ground work W is thus unloaded, whereupon the next work is loaded by the conveyor 85 in the same manner as above, followed by repetitions of the foregoing operations to successively grind workpieces.

When required, the base frame 33 is made movable forward and rearward in its entirety. The base frame 33 is reciprocatingly moved forward and rearward during grinding operation to thereby move the work W reciprocatingly forward and rearward, i.e., in directions parallel to the grinding faces 12*a*, 13*a* and along a phantom line through the center c of the work W and the axis of the wheels 12, 13 as already described with reference to the third embodiment.

The fourth embodiment requires at least two fixed guide rollers 36 for reliably stop the work W at the grinding position while the work is being transported on the belts 34, 35. However, at least one movable guide roller 37 is provided since this roller serves to define the position of the work W radially thereof along with the fixed guide rollers 36.

Although the work W is loaded onto, and unloaded from, the belts 34, 35 by the conveyor 85 according to the fourth embodiment, a suitable work loading-unloading device equipped, for example, with a suction disk may be used for directly loading the work W onto the belts 34, 35 at the portions thereof in front of the work support portions 34*a*, 35*a* and unloading the work W directly from the front portions.

According to the fourth embodiment, the work W is moved rearward to the grinding position provided at the rear of the drive belts 34, 35 and transported forward for unloading from the grinding position. Alternatively, the grinding position can be provided with drive belts extending laterally from opposite sides thereof for loading the work from the left side into the grinding position and unloading the work from the grinding position toward the right side on completion of grinding. In this arrangement, the belts can be driven in one direction for loading and unloading the work. The arrangement, however, requires guide rollers corresponding to the fixed guide rollers 36 of the above embodiment and movable upward and downward, such that the guide rollers are held raised in a standby position during unloading of the work.

Although the belts 34, 35 are adapted to load and unload the work W with the fourth embodiment, these belts 34, 35 may be made operable only for rotating the work W about its own axis. In this case, the belts 34, 35 may have a short length sufficient to support the work W at the grinding position. All the guide rollers 36, 37 may be fixedly positioned, with the holding rollers 38, 39 only made retractable to a suitable position, such that a suitable work loading-unloading device having, for example, a suction plate or the like is used for loading the work W directly onto the work support portions 34*a*, 35*a* of the belts 34, 35 between the guide rollers 36, 37 and unloading the work directly from the support portions.

Flat belts are used as the drive belts 34, 35 of the fourth embodiment, whereas belts of other type such as timing belts are usable.

Fifth Embodiment

Figure 14:
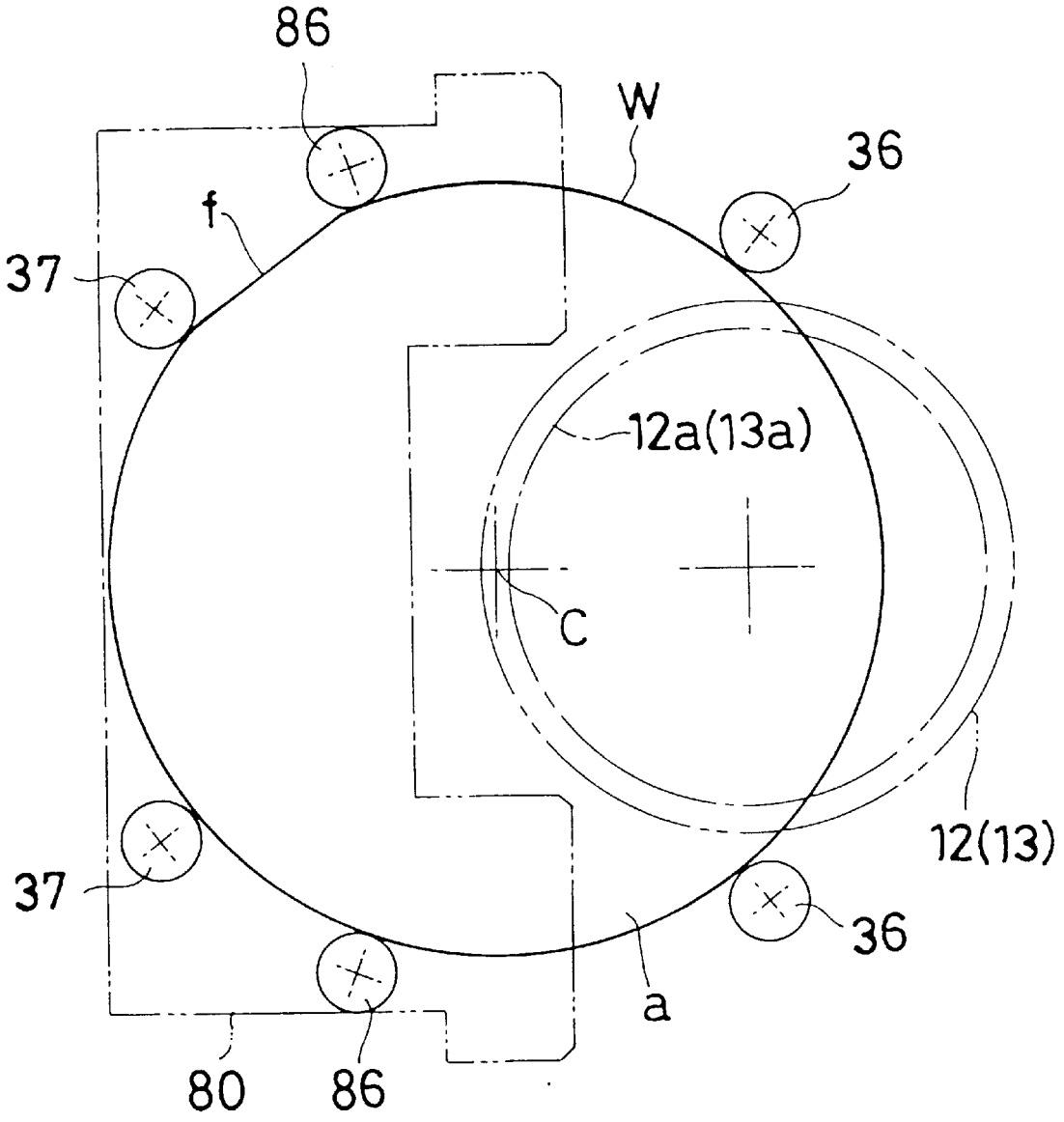
FIG. 14 is a diagram showing the main portion of a work rotating device included in a fifth embodiment of the invention.

FIG. 14 shows a fifth embodiment. The drawing shows only the main components of a portion corresponding to the portion of the fourth embodiment shown in FIG. 12.

The fifth embodiment is adapted for use with work formed with a positioning flat portion f and differs from the fourth embodiment in the number of movable guide rollers 37, 86. Stated more specifically, the fifth embodiment includes two movable guide rollers 37 the same as those of fourth embodiment, and auxiliary movable guide rollers 86 arranged a short distance rearwardly away from the respective rollers 37. The circumferential distance between the movable guide roller 37 and the movable guide roller 86 is slightly greater than the circumferential dimension of the flat portion f. The movable guide rollers 86 are attached to a common lift member 80 together with the movable guide rollers 37 in the same manner as the rollers 37.

With the arrangement of the fifth embodiment, the work W having a flat portion f can be reliably supported radially thereof by the six guide rollers 36, 37, 86. This embodiment is of course usable for grinding work having no positioning flat portion.

The grinding apparatus of the fifth embodiment can be of the same specific construction as the fourth embodiment.

While the fourth and fifth embodiments are vertical spindle double side grinding apparatus wherein the grinding wheels have a vertical axis, these embodiments can be modified as horizontal spindle apparatus wherein the grinding wheels have a horizontal axis. In this case, the work support portion of each drive belt is positioned within a vertical plane parallel to the vertical grinding faces of the horizontal wheels, whereas the belt can be driven in a vertical or horizontal direction or in an oblique direction intermediate between these directions.

Sixth Embodiment

Figure 15:
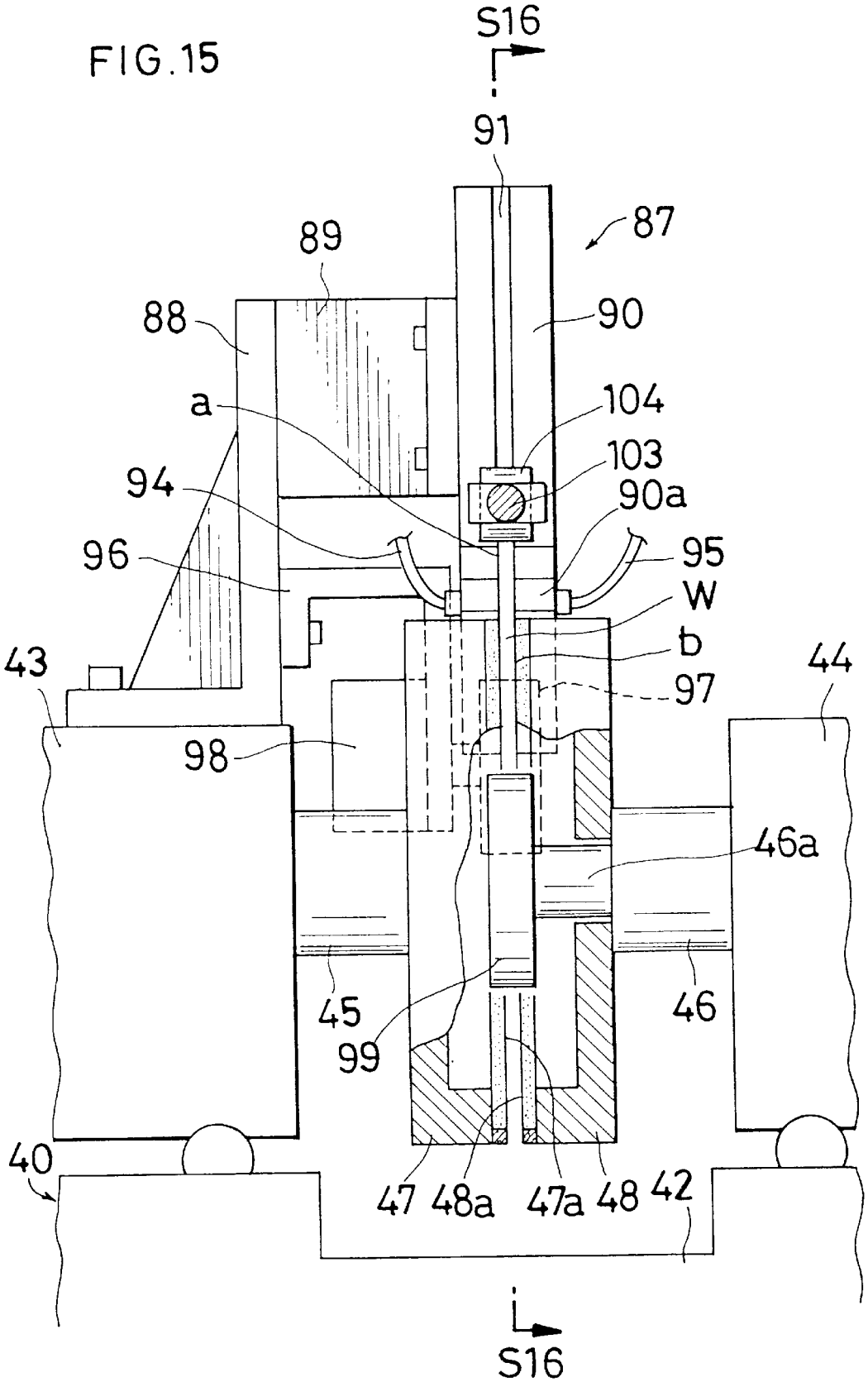
FIG. 15 is a front view partly broken away and showing on an enlarged scale a work rotating device included in a double side grinding apparatus as a sixth embodiment of the invention.
Figure 16:
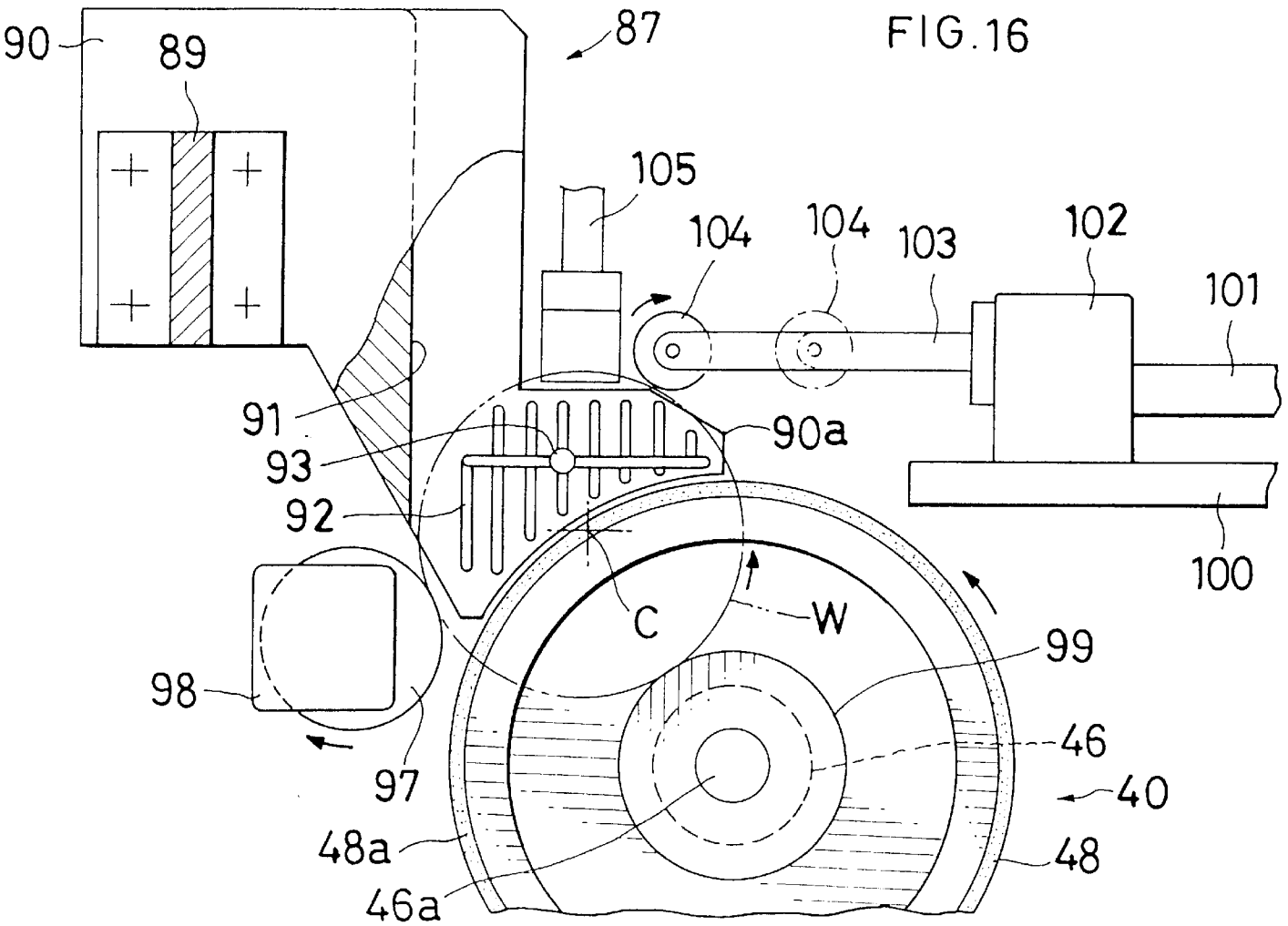
FIG. 16 is a view in section taken along the line S16—S16 in FIG. 15.

FIGS. 15 and 16 show a sixth embodiment, which is designed for work having no positioning flat portion. The embodiment is a double side grinding apparatus comprising a horizontal spindle double head surface grinding machine 40, and a work rotating device 87 added to the machine. In the following description of the sixth embodiment, the front side of the plane of FIG. 15 will be referred to as the "front", and the rear side thereof as the "rear," and the terms "right" and "left" will be used for the apparatus as it is seen from the front rearward. Thus, the right- and left-hand sides of FIG. 15 will be referred to respectively as "right" and "left."

The grinding machine 40 has the same construction as the machine 40 of the third embodiment. In the case of the present embodiment, the left and right grinding wheels 47, 48 are rotated in the same direction (counterclockwise when seen from the left) at the same speed.

As in the case of some of the foregoing embodiments, the work rotating device 87 is adapted to rotate the work about its own axis as vertically supported at the grinding position.

A base 88, L-shaped when seen from behind, is fixed to the upper side of the left wheel head 43. Fixed to the upper portion of right side of the base 88 is a vertical support plate 89 projecting rightward beyond the head 43. Fixed to the right end of the support plate 89 is the left side wall of a static pressure support block 90 in the form of a vertical thick board which is greater in front-to-left width and in height than in lateral thickness. The block 90 has a front portion projecting downward beyond the support plate 89. The downward portion further has a forward projection 90*a*. The projection has an inwardly curved lower edge in the form of a circular-arc, which has a diameter slightly greater than the outside diameter of the wheels 47, 48. The circular-arc portion is positioned immediately above rear portions of the wheels 47, 48. The front portion of the block 90 including the projection 90*a* is formed over the entire length thereof with a slit 91 which is open at the front edge. The slit 91 has a lateral width slightly greater than the thickness of the work W. Static pressure grooves 92 are formed in the opposed surfaces of the right and left side walls of the projection 90*a* which define the slit 91. The opposite side walls of the projection 90*a* defining the slit 91 are each formed with an air supply bore 93 communicating with the grooves 92. Air is supplied to the grooves 92 from outside the block 90, i.e., from an air supply device (not shown) via the bores 93 and hoses 94, 95 in communication with the bores 93.

The support block 90 provides axial support means of the static pressure type for contactlessly supporting the work W with a static pressure axially thereof.

Fixed to the lower portion of right side of the base 88 is a support member 96 extending rightward beyond the wheel head 43. A drive roller (radial support roller) 97 is mounted on the support member 96 so as to be rotatable about a lateral horizontal shaft. An electric motor 98 is also mounted on the support member 96 for rotating the drive roller 97 clockwise when seen from the left. The lateral width of the drive roller 97 is greater than the thickness of the work W. The drive roller 97 is positioned below and to the rear of the slit 91 in the projection 90*a* of the block 90, in the rear of the wheels 47, 48, and slightly above the axis of the wheels 47, 48.

The right wheel spindle 46 is formed at its left end with a small-diameter portion 46*a* extending leftward through a disk portion of the wheel 38 at its right end. A guide roller (radial support roller) 99 having an outside diameter smaller than the inside diameter of the grinding face 48*a* is mounted on the left end of the small-diameter portion 46*a* located inside the grinding face 48*a* so as to be idly rotatable about the axis of the wheel shaft 46. The right end of the guide roller 99 is positioned slightly rightwardly (inwardly) of the grinding face 48*a*. The guide roller 99 projects rightward beyond the grinding face 48*a* by an amount greater than the thickness of the work W. While the opposed grinding wheels 47, 48 are in the grinding position, the Left end of the guide roller 99 is positioned inwardly of the grinding face 47*a* of the left wheel 47.

Although not shown in detail, the base 88 is fixedly provided at a suitable portion with a horizontal support plate 100 extending from the wheel head 43 to a location above the front side of the right wheel spindle 46. Mounted on the plate 100 is a movable member 102 movable forward and rearward by a suitable actuator 101 such as an air cylinder. A support bar 103 extending horizontally rearward is secured to the movable member 102. A holding roller (radial support roller) 104 is mounted on the rear end of the support bar 103 so as to be idly rotatable about a lateral horizontal shaft. The holding roller 104 has a lateral width greater than the thickness of the work W. The holding roller 104 is brought to a rear limit position, i.e., operating position, shown in a solid line in FIG. 16 or alternatively to a front limit position, i.e., standby position, indicated in a broken line in FIG. 16 by the movement of the movable member 102. When in the operating position, the roller 104 is situated immediately above the slit 91 of front portion of the block projection 90*a*. When in the standby position, the roller is located above front portions of the wheels 47, 48 and forwardly away from the projection 90*a*.

The work W is supported in the grinding position, as placed in a vertical posture on the drive roller 97 and the guide roller 99. At this time, an approximate upper half portion of the work W is positioned in the slit 91 of the block projection 90*a*, and the lower work portion projecting out from the underside of the block 90 is in contact, at two peripheral parts, with the drive roller 97 and the guide roller 99. The holding roller 104 is in contact with the top portion of the work W projecting outward from the projection 90*a*.

The drive roller 97, guide roller 99 and holding roller 104 provide radial support means for defining the position of the work W radially thereof. The drive roller 97 provides drive means for rotating the work W.

With the present embodiment, the outside diameter of the wheels 47, 48 is slightly greater than the sum of the outside diameter of the work W and the outside diameter of the guide roller 99, so that the center c of the work W supported at the grinding position is positioned between the outer and inner peripheries of upper portions of the grinding faces 47*a*, 48*a*.

Although not shown in great detail, the grinding apparatus has an autoloader 105 serving as work loading-unloading means for automatically loading the work W onto the rotating device 87 and unloading the work therefrom.

The work W is ground, for example, by the following operation.

The left and right wheels 47, 48 are always in rotation during the grinding work. Air is supplied to the grooves 92 in the block 90 at all times. When the operation is to be started, the wheels 47, 48 are in their respective standby positions a short distance leftwardly and rightwardly away from the grinding position, with the holding roller 104 in its standby position. In this state, the work W is held at an upper edge portion by the autoloader 105, fed to the space between the wheels 47, 48 through the slit 91 of the block 90, and placed on the drive roller 97 and the guide roller 99, whereupon the holding roller 104 is brought to the operating position into contact with the outer periphery of the work W. The autoloader releases the work W and moves upward to a standby position. The work W is contactlessly supported radially thereof with the static pressure of the air supplied to the grooves 92 of the block 90, and is also supported by the rollers 97, 99, 104 radially thereof. Thus, the work is supported at the specified grinding position. At this time, the lower portion of the work W is positioned between the opposed wheels 47, 48, with the center c of the work W positioned between the outer and inner peripheries of upper portions of the grinding faces 47*a*, 48*a*.

When the work W is supported at the grinding position, the drive roller 97 starts to rotate. The work W in the grinding position is rotated approximately about its center c by a frictional force acting between the drive roller 97 and the outer periphery of the work W.

With the start of rotation of the work W, the wheels 47, 48 are moved toward each other to bring the grinding faces 47*a*, 48*a* into contact with the respective work faces a, b opposed thereto. The wheels 47, 48 are brought to predetermined grinding positions which are dependent on the dimension to which the work W is to be finished, and are held in the respective positions for a specified period of time, whereby the opposite work surfaces a, b are entirely ground at the same time as in the case of the first embodiment.

On completion of grinding of the work W, the wheels 47, 48 leave the work W and further move to the standby positions at left and right. Upon the wheels 47, 48 leaving the work W, the drive roller 97 is brought to a halt, consequently stopping the rotation of the work W. When the work W is brought to a stop, an upper edge portion of the work W is gripped by the autoloader, the holding roller 104 is moved to its standby position, and the work W is passed through the slit 91 of the block 90 and delivered to a position thereabove. Subsequently, the next work W is loaded into the grinding position in the same manner as above. Workpieces are thereafter ground one after another by repeating the foregoing operation.

In the case of the sixth embodiment, the vertical work W is subjected to a downward force under gravity, the wheels 47, 48 are rotated counterclockwise when seen from the left, and the rear upper portions of the grinding faces 47*a*, 48*a* moving rearwardly downward obliquely are in contact with the work W, so that the work W is acted on with a rearwardly downward oblique force by the rotation of the wheels 47, 48, pressed against the drive roller 97 which is positioned in this direction and therefore reliably rotated. The drive roller 97 exerts a forwardly downward oblique force on the work W, which in turn is pressed against the guide roller 99 which is located in this direction. The work W is rotated as supported in the predetermined grinding position by the two rollers 97, 99. Accordingly, the upper holding roller 104 need not always be provided. However, when used, the holding roller 104 prevents the work W from being raised, and can be rotated as reliably supported at the grinding position.

Seventh Embodiment

Figure 17:
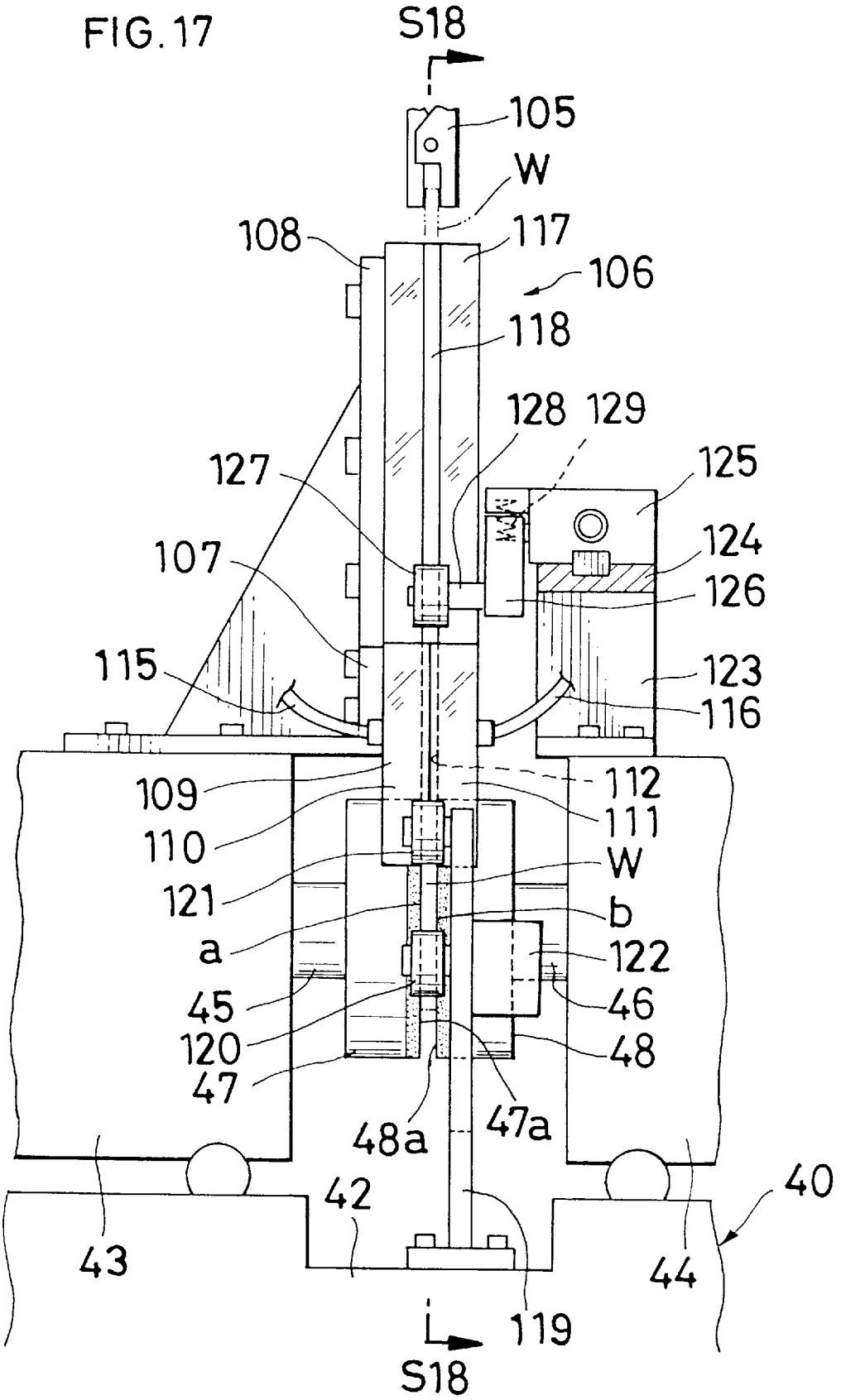
FIG. 17 is a front view showing on an enlarged scale a work rotating device included in a double side grinding apparatus as a seventh embodiment of the invention.
Figure 18:
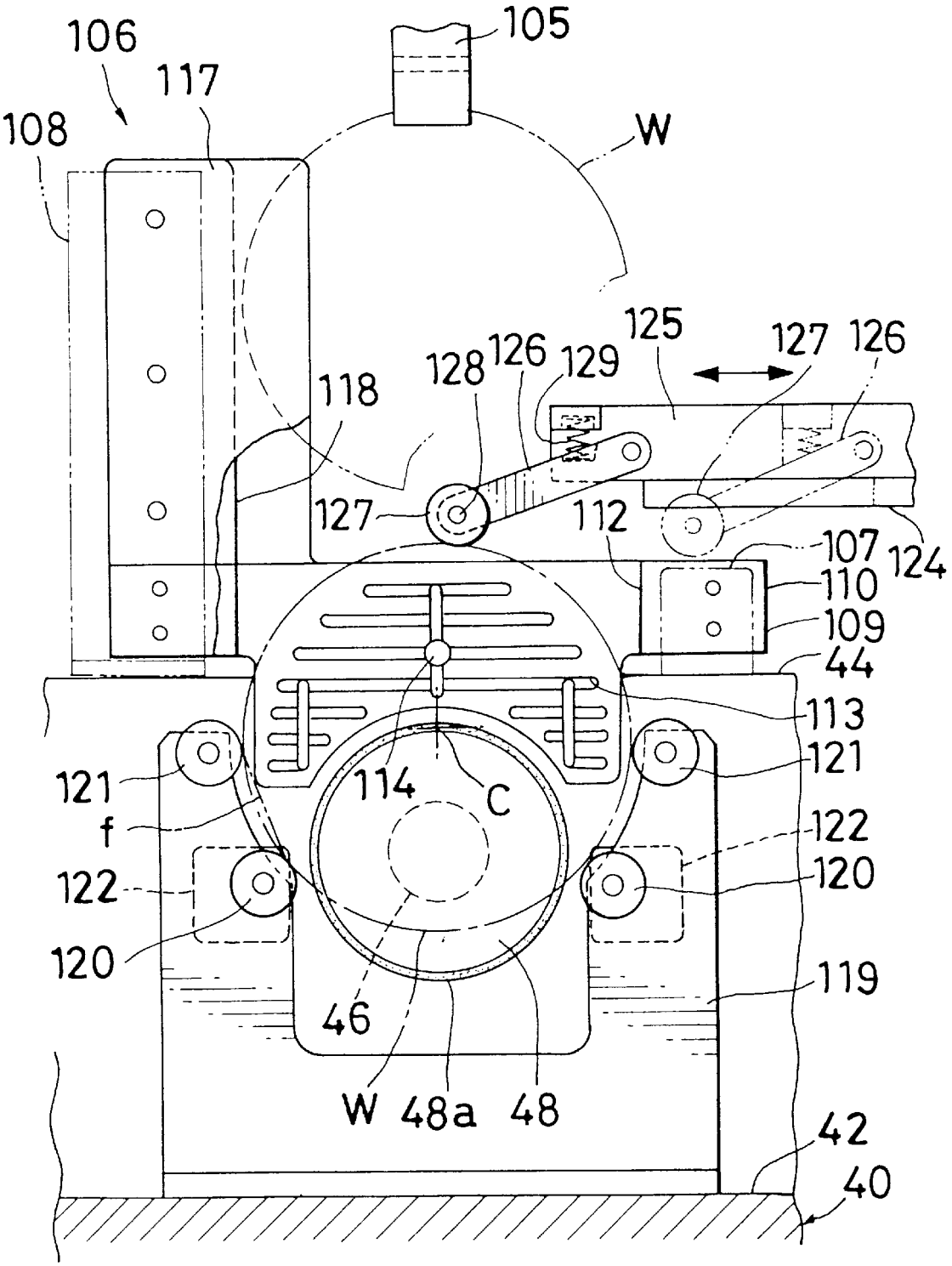
FIG. 18 is a view in section taken along the line S18—S18 in FIG. 17.

FIGS. 17 and 18 show a seventh embodiment, which is used for both work having no positioning flat portion and work formed with a flat portion. The embodiment is a double side grinding apparatus which comprises a horizontal spindle double head surface grinding machine 40, and a work rotating device 106 added to the machine. In the following description of this embodiment, the front side of the plane of FIG. 17 will be referred to as the "front", and the rear side thereof as the "rear," and the terms "right" and "left" will be used for the apparatus as it is seen from the front rearward. Thus, the right- and left-hand sides of FIG. 17 will be referred to respectively as "right" and "left."

The grinding machine 40 is the same as the machine included in the sixth embodiment.

The work rotating device 106 is provided in an arrangement including the bed 42 and right and left grinding wheels 43, 44.

The left wheel head 43 is fixedly provided on its upper side with a pair of front and rear bases 107, 108 projecting rightward from the head 43 and L-shaped when seen from behind. A static pressure support block 109 in the form of a thick vertical board is fixed at its front and rear ends to the right side of the front base 107 and to the right side lower portion of the rear base 108. The block 109 comprises, for example, right and left two plates 110, 111 fitted together face-to-face, and projects downward at its middle portion with respect to the front-rear direction (longitudinal direction). This projection has an inwardly curved circular-arc edge having a diameter slightly greater than the outside diameter of the grinding wheels 47, 48. The circular-arc portion is positioned immediately above the wheels 47, 48. The block 102 has a slit 112 defined by the plates 110, 111 over the entire height thereof except at its front and rear ends. The front-to-rear width of the slit 112 is slightly greater than the outside diameter of the work W, and the lateral thickness of he slit is slightly larger than the thickness of the work W. Static pressure grooves 113 are formed in the opposed surfaces of the plates 110, 111 at the portions thereof defining the slit 112. The grooves 113 of the plates 110, 111 are in communication with air supply hoses 115, 116 via air supply bores 114.

A guide block 117 in the form of a vertical thick board is fixed to the right side of the rear base 108 on the portion thereof above the support block 109. The guide block 117 also comprises right and left two plates which are fitted together face-to-face. These plates have front portions defining a slit 118 communicating with the upper side of rearward portion of the slit 112 of the block 109, extending over the entire length of the plates and open at the front edges of the plates. The right and left walls and rear wall (bottom wall) of the guide block 117 defining the slit 118 are in coincidence with the corresponding respective walls of the support block 109.

The bed 42 between the opposed wheel heads 43, 44 is fixedly provided on its upper side with a vertical support plate 119 extending upward, forward and rearward. The support plate 119 is generally channel-shaped when seen from right or left and extends upward at the front and rear sides of the wheels 47, 48 to terminate at the front and rear sides of the lower projection of the block 109. The front and rear upper portions of the support plate 119 are provided with radial support rollers 120, 121 four in total number and rotatable each about a lateral horizontal shaft, two upper rollers 121 being positioned above the other two rollers 120. The distance between the two lower rollers 120 is smaller than the distance between the two upper rollers 121. These four rollers 120, 121 are adapted to support the work W as positioned vertically thereon. The distance between the two rollers 120, 121 at the front, as well as the distance between the two rollers 120, 121 at the rear, is slightly greater than the circumferential dimension of the positioning flat portion f of the work W. The two lower rollers 120 are drive rollers which are driven in the same direction by respective electric motors 122 mounted on the support plate 119. The distance between the drive rollers 120 is greater than the circumferential dimension of the positioning flat portion f of the work W. The two upper rollers 121 are guide rollers which are freely rotatable. The rollers 120, 121 have a lateral (right-to-left) width greater than the thickness of the work W. The midpoints of lateral width of the rollers 120, 121 are positioned approximately in coincidence with the midpoint of lateral thickness of the slit 112 in the support block 109.

Fixed to the upper side of the right wheel head 44 is a base 123 projecting slightly leftward beyond the head 44. A horizontal guide plate 124 extending longitudinally of the apparatus and fixed to the top of the base 123 has mounted thereon a movable member 125 which is movable forward and rearward by an unillustrated suitable actuator such as an air cylinder or ball screw. An arm 126 extending obliquely rearwardly downward is pivoted at its front end to the movable member 125 at a portion thereof toward its rear end so as to be movable about a horizontal lateral pin. A holding roller (radial support roller) 127 is mounted on the rear end of the arm 126 idly rotatably on a shaft 128 extending leftward. The rear end of the arm 126 is biased downward by a spring 129. The holding roller 127 has a lateral width larger than the thickness of the work W. The roller 127 is brought to a rear limit position, i.e., operating position, indicated in solid line in FIG. 18, or alternatively to a front limit position, i.e., standby position, indicated in broken line in the drawing, by the movement of the movable member 125. When in the operating position, the roller 127 is located immediately above the longitudinal midportion of the slid 112 of the block 109. When in the standby position, the roller 127 is situated immediately above a portion of the block 109 to the front of the slit 112.

The work W is placed in a vertical posture on the two drive rollers 120 and two guide rollers 121 and supported at the grinding position. At this time, an approximate upper half portion of the work W is positioned in the slit 112 of the block 109, and the outer periphery of the lower portion of the work W projecting outward from the front, rear and lower sides of the block 109 are in contact with the rollers 120, 121. The holding roller 127 brought to its operating position is pressed by the spring 129 against the top of the work W slightly projecting upward beyond the block 109.

The drive rollers 120, guide rollers 121 and holding roller 127 provide radial support means for defining the position of the work W radially thereof. The drive rollers 120 provide drive means for rotating the work W.

With the present embodiment, the outside diameter of the wheels 47, 48 is about 65% of the outside diameter of the work W. The center c of the work W supported at the grinding position is located between the outer and inner peripheries of upper portions of the grinding faces 47*a*, 48*a*.

As is the case with the sixth embodiment, the grinding apparatus is equipped with an autoloader 105.

The work W is ground, for example, in the following manner.

When the operation is to be started, the holding roller 127 is in its standby position. In this state, the work W is fed to a space between the opposed wheels 47, 48 through the slit 118 of the guide block 117 and slit 112 of the support block 109 and placed on the drive rollers 120 and the guide rollers 121 by the autoloader 105. When the work W is placed on the rollers 120, 121, the autoloader 105 releases the work W and moves upward to a standby position. The holding roller 127 is brought to its operating position into pressing contact with the top of the work W. The work W is contactlessly supported axially thereof with the static pressure of the air supplied to the grooves 113 of the block 109, and also supported by the rollers 120, 121, 127 radially thereof, whereby the work is supported at the specified grinding position. At this time, the lower portion of the work W is positioned between the opposed wheels 47, 48, with the center c of the work W positioned between the outer and inner peripheries of upper portions of the grinding faces 47*a*, 48*a*.

With the work W in the grinding position, the drive rollers 120 start to rotate. The work W is rotated approximately about its center c at the grinding position by a frictional force acting between the work outer periphery and the drive rollers 120.

With the start of rotation of the work W, the wheels 47, 48 are brought to the grinding position as in the case of the sixth embodiment and held in this position for a specified period of time. During this time, both work surfaces a, b are entirely ground at the same time.

When completely ground, the work W is released from the wheels 47, 48, which further move leftward and rightward to their respective standby positions. Upon the wheels 47, 48 leaving the work W, the drive rollers 120 are brought to a stop to discontinue the rotation of the work W. When the work W is brought out of rotation, the holding roller 127 is moved to the standby position. The work W is passed through the slid 112 of the support block 109 and the slit 118 of the guide 117 and delivered to a location thereabove by the autoloader 105.

The operation is the same as that of the sixth embodiment with the exception of the above procedures.

With the seventh embodiment, the vertical work W is subjected to a downward force under gravity. When having no positioning flat portion, the work W is supported at the grinding position and rotated by the four rollers 120, 121 which are in contact with the work lower portion at all times. Even when formed with a positioning flat portion f, the work W has its lower portion opposed to two rollers 120, 121 at each of two locations, the two rollers 120, 121 in each location being spaced apart by a distance slightly greater than the circumferential dimension of the flat portion f, so that at each of the two locations, at least one of the two rollers 120, 121 is always in contact with the outer periphery of the work W at a part thereof other than the flat portion f.

Further because the two drive rollers 120 are spaced apart by a distance greater than the circumferential dimension of the flat portion f, at least one of the drive rollers 120 is always in contact with the work outer periphery at a part thereof other than the flat portion f. The work W is supported at the specified grinding position by the four lower rollers 120, 121 and driven by the drive rollers 120. The upper holding roller 127 is therefore not always necessary. However, the holding roller 127, if provided, serves to prevent the work W from being raised, permitting the work W to be reliably supported at the grinding position for rotation. The holding roller 127 is biased by the spring 129 downward, i.e., radially inwardly of the work W, therefore follows the contour of the work W and can always be held in pressing contact with the work outer periphery including the flat portion f.

Eighth Embodiment

Figure 19:
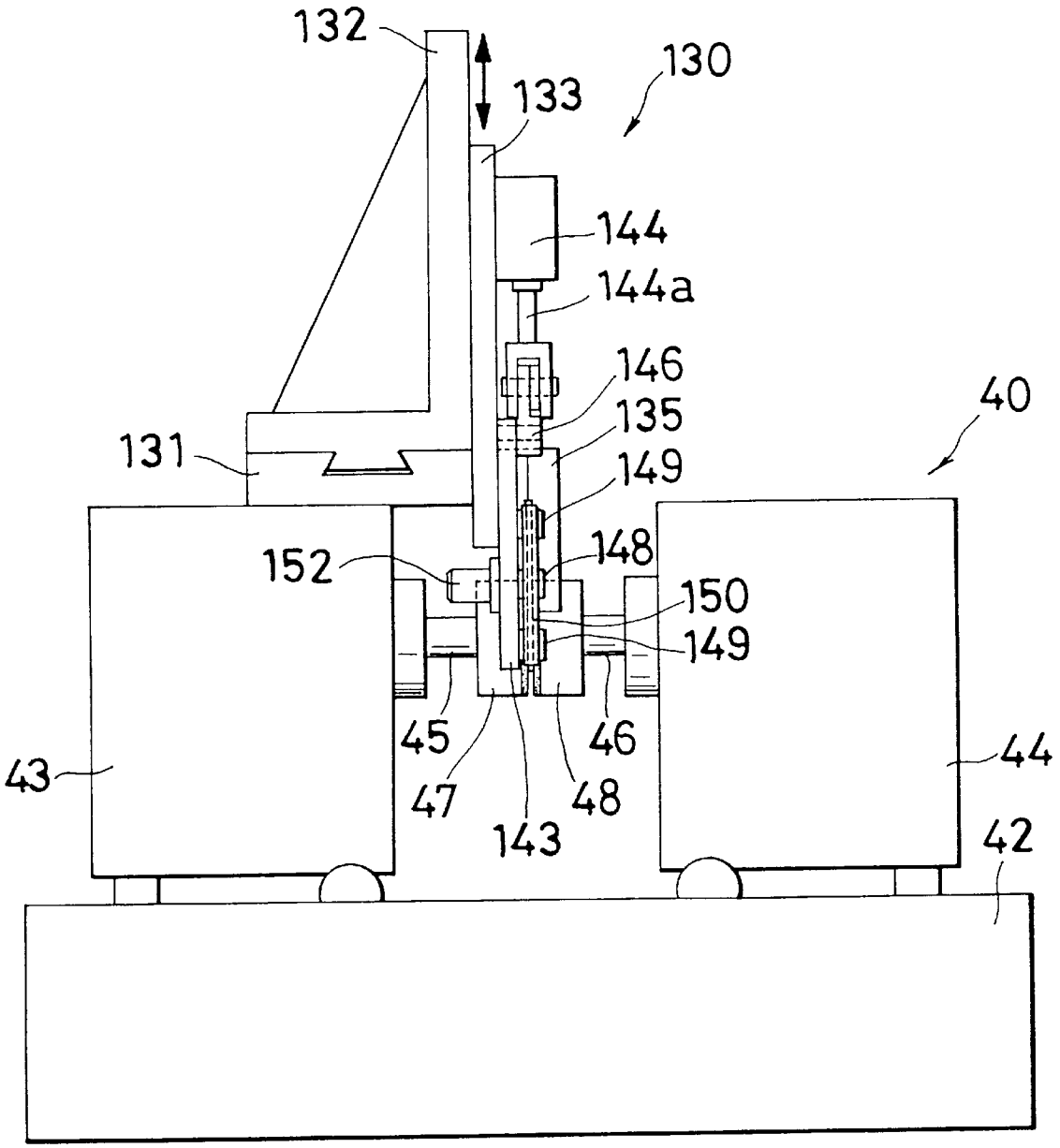
FIG. 19 is a front view schematically showing a double side grinding apparatus as an eighth embodiment of the invention.
Figure 20:
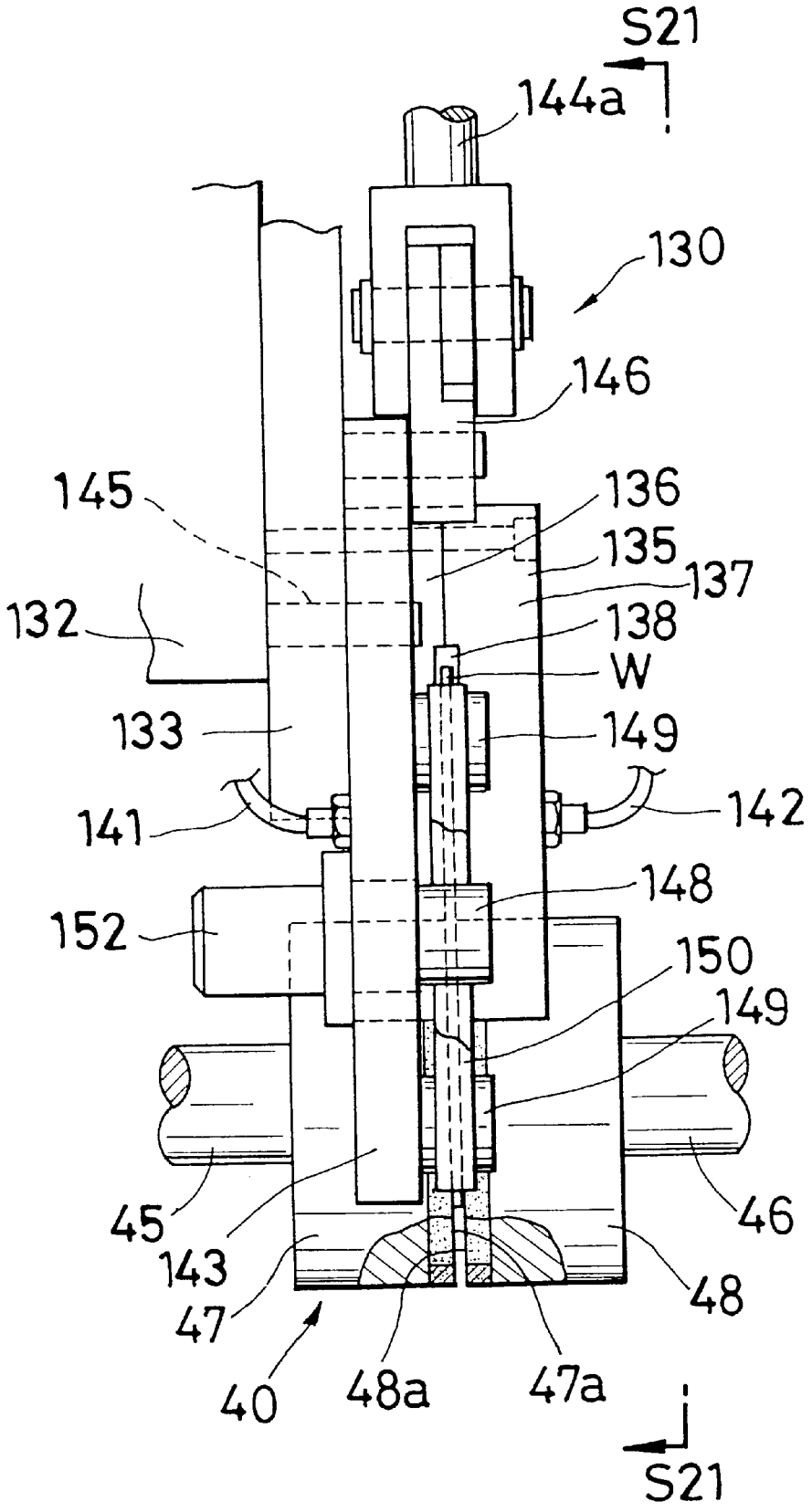
FIG. 20 is a front view partly broken away and showing on an enlarged scale the main portion a work rotating device included in the eighth embodiment.

FIGS. 19 to 24 show an eighth embodiment. FIG. 19 shows the overall construction of the embodiment, which is a double side grinding apparatus. The eighth embodiment is used for both work having no positioning flat portion and work formed with such a flat portion. The grinding apparatus comprises a horizontal spindle double head surface grinding machine 40, and a work rotating device 130 added to the machine. The rotating device 130 is shown in detail in FIGS. 20 to 24. In the following description of this embodiment, the front side of the plane of FIG. 19 will be referred to as the "front", and the rear side thereof as the "rear," and the terms "right" and "left" will be used for the apparatus as it is seen from the front rearward. Thus, the right- and left-hand sides of FIG. 19 will be referred to respectively as "right" and "left."

The grinding machine 40 is the same as the machine included in the sixth embodiment.

The rotating device 130 is provided on the left wheel head 43.

Fixed to the upper side of the head 43 is a base 131 elongated in the front-to-rear direction (longitudinal direction) and projecting slightly rightward beyond the head 43. A horizontal movable member 132, L-shaped when seen from behind, is mounted on the base 131. The movable member 132 is movable forward and rearward along the upper surface of the base 131 by unillustrated drive means. Attached to the right side of the member 132 is a lift member 133 in the form of a plate and extending vertically. The lift member 133 is movable upward and downward along the right side surface of the movable member 132.

The lower end of the lift member 133 is cut out in a trapezoidal form at the midportion thereof with respect to the front-rear direction. A static pressure support block 135 in the form of a vertical board is fixed at its upper portion to the lift member 133 at the lower edge portion defining the middle part of the cutout 134. The block 135 is formed, for example, by fitting two left and right plates 136, 137 face-to-face. The block 135 projects downward beyond the cutout lower edge of the lift member 133 and has an inwardly curved circular-arc lower edge with a diameter slightly greater than the outside diameter of the grinding wheels 47, 48. The maximum width, in the front-rear direction, of the portion of the block 135 projecting downward beyond the lift member 133 is slightly smaller than the outside diameter of the work W. This portion has a slit 138 extending over the entire width thereof and also to the lower edge. The lateral dimension (in right-left direction) of the slit 138 is slightly greater than the thickness of the work W. Static pressure grooves 139 are formed in the opposed surfaces of the plates 136, 137 defining the slit 138. The grooves 139 in the plates 136, 137 communicate with air supply hoses 141, 142 via air supply bores 140.

Figure 21:
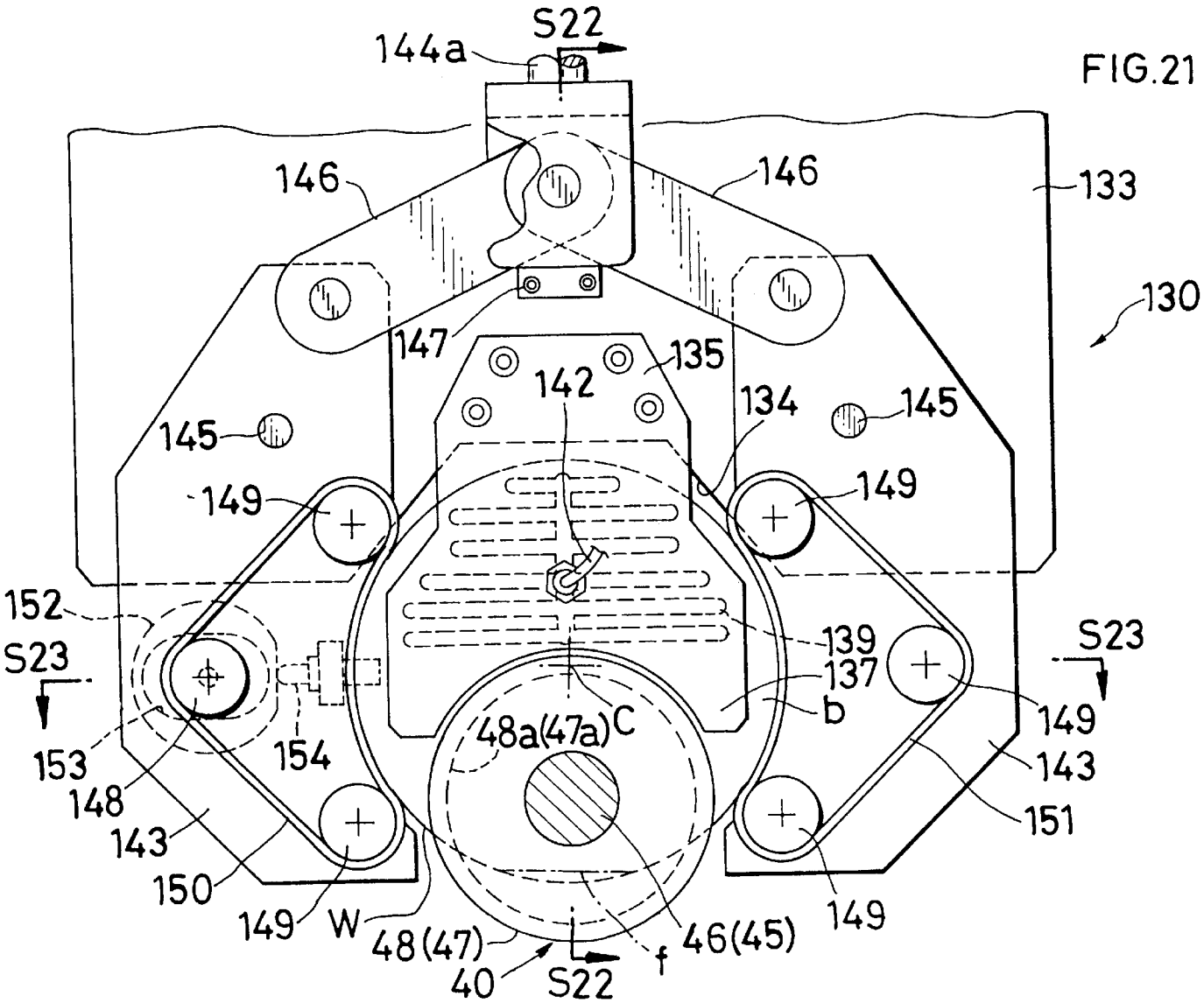
FIG. 21 is a view in section taken along the line S21—S21 in FIG. 20.
Figure 22:
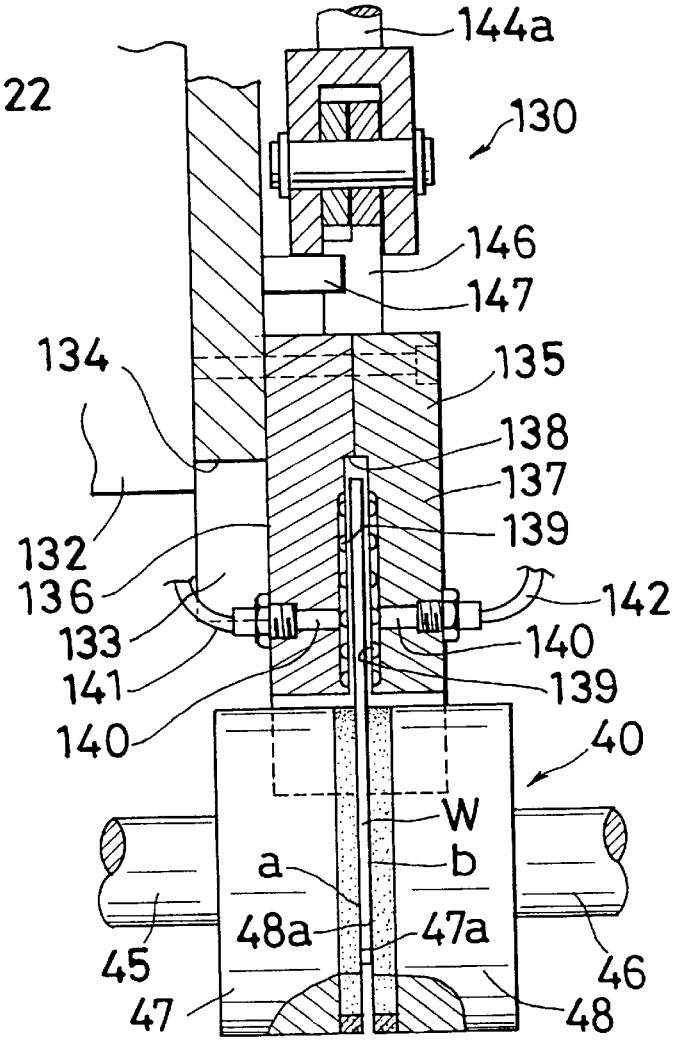
FIG. 22 is a view in section taken along the line S22—S22 in FIG. 21.
Figure 23:
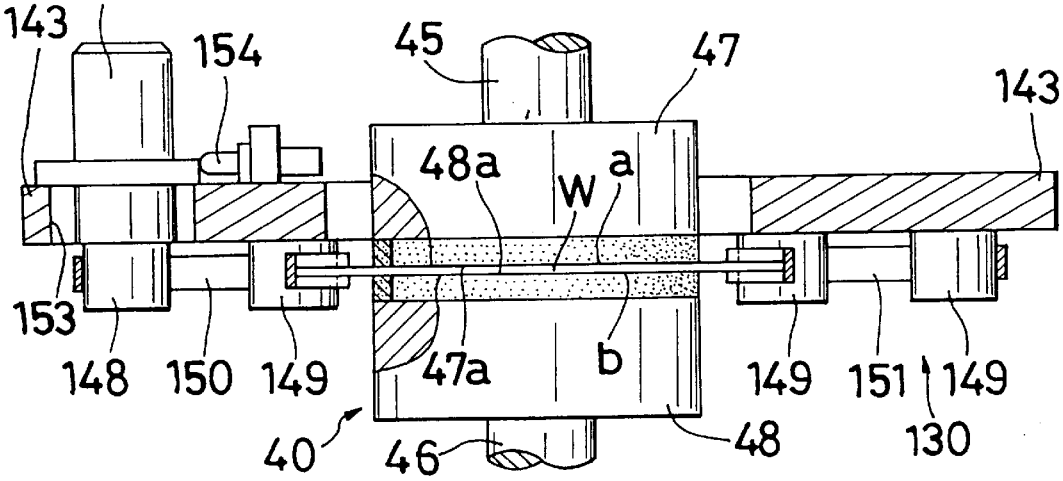
FIG. 23 is a view in section taken along the line S23—S23 in FIG. 21.
Figure 24:
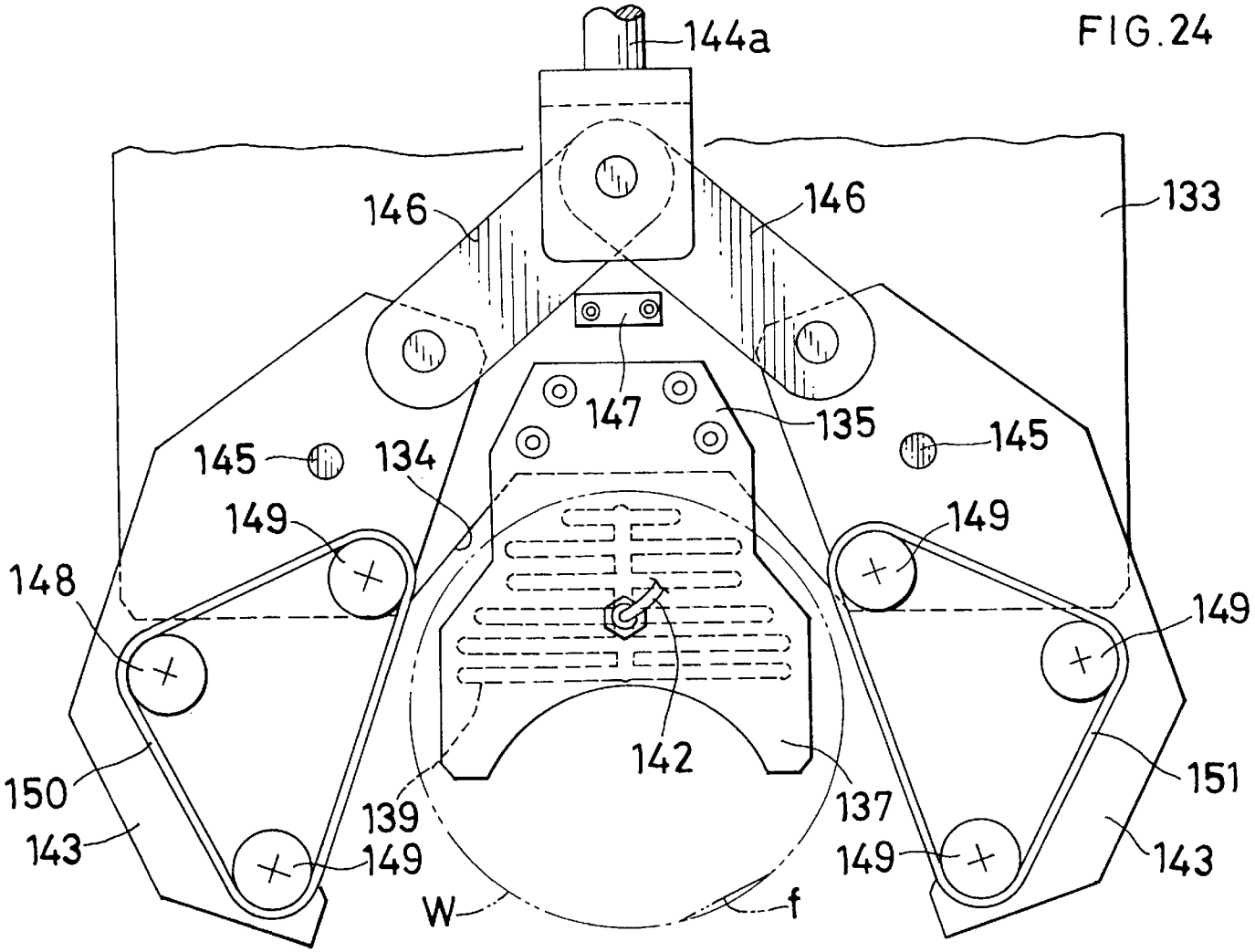
FIG. 24 is a view corresponding to FIG. 21 and showing an opening-closing member as opened.

Mounted on the right side of the lift member 133 are a pair of front and rear opening-closing members 143 parallel to the lift member 133 and each in the form of a plate, and an air cylinder 144 for opening and closing the members 143. Two pins 145 extending horizontally rightward are fixed respectively to front and rear two portions of the lift member 133 toward the lower end thereof. An upper portion of each opening-closing member 143 is rotatably mounted on the pin 145 approximately at the middle of the member with respect to the front-rear direction. The cylinder 144 is attached as directed downward to an upper portion of the lift member 133 at the middle thereof with respect to the front-rear direction. The cylinder has a rod 144*a*, the lower end of which is connected by a link 146 to each opening-closing member 143 at an inner part, with respect to the front-rear direction, of its upper end. A stopper 147 for restraining the rod 144*a* from moving downward is fixed to the lift member 133 at a position under the cylinder 144 and slightly above the block 135. The level of the stopper 147 is adjustable. When the rod 144*a* advances to a lower limit position into contact with the stopper 147, this movement pivotally moves the pair of opening-closing members 143 to a closed position in which the members are positioned generally vertically with their lower ends closed as seen in FIG. 21. When the rod 144*a* is retracted to an upper limit position a predetermined distance upwardly away from the stopper 147, the pair of opening-closing members 143 are pivotally moved to an open position wherein their lower ends are away from each other as seen in FIG. 24.

Three rollers 148, 149 are mounted on each opening-closing member 143 on the right surface of the portion thereof projecting downward beyond the cutout lower edge of the lift member 133, each of the rollers being rotatable about a shaft extending horizontally rightward. An endless positioning belt 150 (151) is reeved around the three rollers 148, 149 on each opening-closing member 143. The belts 150, 151 are adapted to hold the work W projecting from the block 135 and from between the wheels 47, 48, at diametrically opposite sides (opposite sides in front-rear direction) of its outer periphery to support the work W radially thereof, and to rotate the work W about its own axis. The belts are made of a suitable flexible material such as rubber. The belts 150, 151 have a flat outer surface and a width greater than the thickness of the work W. The centers of width of the belts 150, 151 are positioned substantially in coincidence with the center, with respect to the right-left direction, of the slit 138 of the block 135. The three rollers 148, 149 are arranged on the portion of the opening-closing member 143 projecting downward, at upper and lower two locations which are inward with respect to the front-rear direction, and at an intermediate part of height of the projecting portion which part is outward with respect to the front-rear direction. The three rollers 149 on the rear member 143 and the two rear rollers 149 on the front member 143 are each a guide roller freely rotatable about a pin (not shown) fixed to the member 143. The rear belt 151 is a driven belt movable longitudinally thereof with the rotation of the work W. The front roller 148 on the front member 143 is a drive roller to be driven by an electric motor 152. The front belt 150 on this roller is a drive belt to be driven longitudinally thereof for rotating the work W. The lower projecting portion of the front member 143 is formed with a hole 153 which is elongated in the front-rear direction when the member is in the closed position. The forward end (right end) of the motor 152, which is directed horizontally rightward, is inserted in the elongated hole 153 so as to be movable along the length of the hole 153 (front-rear direction) but not to be movable axially of the hole (right-left direction). The drive roller 148 is fixed to the outer end of the motor shaft (not shown) projecting rightward through the opening-closing member 143. The front member 143 is provided on the left surface of its lower projecting portion with a spring-incorporating plunger 154 for biasing the motor 152 forward, whereby the drive roller 148 is biased forward to given a specified tension to the drive belt 150.

The pair of belts 150, 151 provide radial support means for defining the position of the work W radially thereof. The drive roller 150 provides drive means for rotating the work W.

With the present embodiment, the outside diameter of the wheels 47, 48 is about 70% of the work W. The center c of the work W as supported at the grinding position is positioned between the outer and inner peripheries of upper portions of the grinding faces 47*a*, 48*a*.

Although not shown, a work loading device and a work unloading device are arranged at a suitable location to the rear of the grinding machine 40. The base 131 of the rotating device 130 extends to above these loading and unloading devices.

The work W is ground, for example, by the following operation.

When the work is to be started, the lift member 133 is in a standby raised position wherein the lowermost portions of the opening-closing members 143 are positioned above the wheels 47, 48, and the front and rear opening-closing members 143 are in the open position.

In this state, the movable member 132 first moves to a position above the work loading device. At the work loading device, one workpiece W is fed at a time to a specified loading position, in a vertical posture with the work surfaces facing rightward or leftward. The movable member 132 stops when the belts 150, 151 of the opening-closing members 143 in open position are brought to immediately above the work W at the loading position. The lift member 133 thereafter descends to the loading position. This positions the work W into a space between the front and rear belts 150, 151, with the upper portion of the work W inserted into the slit 138 of the block 135. The work is supported axially thereof with the static pressure of the air supplied to the grooves 139. At this time, the opposed portions of the front and rear belts 150, 151 are away from the front and rear outer peripheral portions of the work W and straight as shown in FIG. 24. Next, the cylinder rod 144*a* advances into contact with the stopper 147, whereby the opening-closing members 143 are closed. When the members 143 are brought to the closed position, the front-to-rear distance between the opposed portions of the front and rear belts 150, 151 becomes smaller than the diameter of the work W. While the members 143 are progressively closed, however, the front and rear peripheral portions of the work W first come into pressing contact with the respective belts 150, 151, further bending the opposed portions of the flexible belts 150, 151 forwardly and rearwardly outward along the outer periphery of the work W. With the present embodiment, the front and rear portions of the work W corresponding to about ¼ of its circumference come into pressing contact with the belts 150, 151 when the members 143 are brought to the closed position, whereby the work W is supported radially thereof. With the members 143 in the closed position, the lift member 133 rises to its standby position. Consequently, the work W is supported by the belts 150, 151 and the block 135 and raised from the work loading device.

After the ascent of the lift member 133 to the standby position, the movable member 132 moves to and stops at a position above a line through the opposed grinding wheels 47, 48. This movement is followed by a descent of the lift member 133 to a specified grinding work position, and the drive roller 148 rotates. With the lift member 133 in the grinding work position, the work W is located at the grinding position, with the lower portion of the work W positioned between the opposed wheels 47, 48 and with the center c of the work positioned between the outer and inner peripheries of upper portions of the grinding faces 47*a*, 48*a* as seen in FIG. 21. The rotation of the drive roller 148 drives the drive belt 150 longitudinally thereof, and the belt portion opposed to the work W moves circumferentially of the work. The peripheral work portion in pressing contact with the belt 150 is moved in the circumferential direction by a frictional force acting between the belt 150 and the work, whereby the work W is rotated. The rotation of the work W also circumferentially moves the work peripheral portion in pressing contact with the driven belt 151, moving the portion of the belt 151 opposed to the work longitudinally of the belt owing to a frictional force between the work and the belt 151. As a result, the work W rotates approximately about the center c in the grinding position.

When the work W is initiated into rotation after the descent of the lift member 133 to the grinding work position, the wheels 47, 48 are moved to their grinding work position and held in this position for a specified period of time as in the sixth embodiment. During this period, both work surfaces a, b are entirely ground at the same time. Since the front-to-rear spacing between the front and rear opening-closing members 143 in the closed position is larger than the outside diameter of the wheels 47, 48, the members 143 are unlikely to interfere with the wheels 47, 48 at this time. When required, the lift member 133 is reciprocatingly moved upward and downward during grinding as already described with reference to the third embodiment, whereby the work W is reciprocatingly moved upward and downward, i.e., in directions parallel to the grinding faces 47*a*, 48*a* and along a line through the center c of the work W and the axis of the wheels 47, 48.

On completion of grinding, the wheels 47, 48 leave the work W and further move leftward and rightward to their standby positions. Upon the wheels 47, 48 leaving the work W, the drive roller 148 is brought out of rotation, and the lift 133 rises to its standby position. When stopped, the roller 148 also stops the belts 150, 151 and the work W. The ascent of the lift member 133 to the standby position is followed by the movement of the movable member 132 to a position above the work unloading device to position the work W immediately above a predetermined unloading work position. With the movable member 132 halted, the lift member 133 descends to the unloading work position. The cylinder rod 144*a* retracts to bring the opening-closing members 143 to the open position, whereby the work W is released from the belts 150, 151, transferred to the unloading work position and unloaded from the apparatus by the unloading device. When the work W is released by the opening of the members 143, the lift member 133 ascends to its standby position. The above operation is thereafter repeated to grind workpieces one after another.

The eighth embodiment operates in the same manner as the sixth embodiment with the exception of the above procedures.

According to the eighth embodiment, the belts 150, 151 which are made of elastic material are pressed into contact with the outer periphery of the work W and are deformed freely in conformity with the contour of the work W, so that the work W can be reliably rotated with its outer periphery supported by the belts, regardless of whether the work has the positioning flat portion f.

A plurality of drive rollers 148 may be used for driving the drive belt 150. Furthermore, the pair of belts 150, 151 may be used as drive belts.

Although the pair of opening-closing members 143 are pivotally moved for opening and closing according to the eigth embodiment, such members may be translated for opening and closing. The means for supporting the belts 150, 151 need not always be provided on the opening-closing members; desired support means is usable.

Ninth Embodiment

Figure 25:
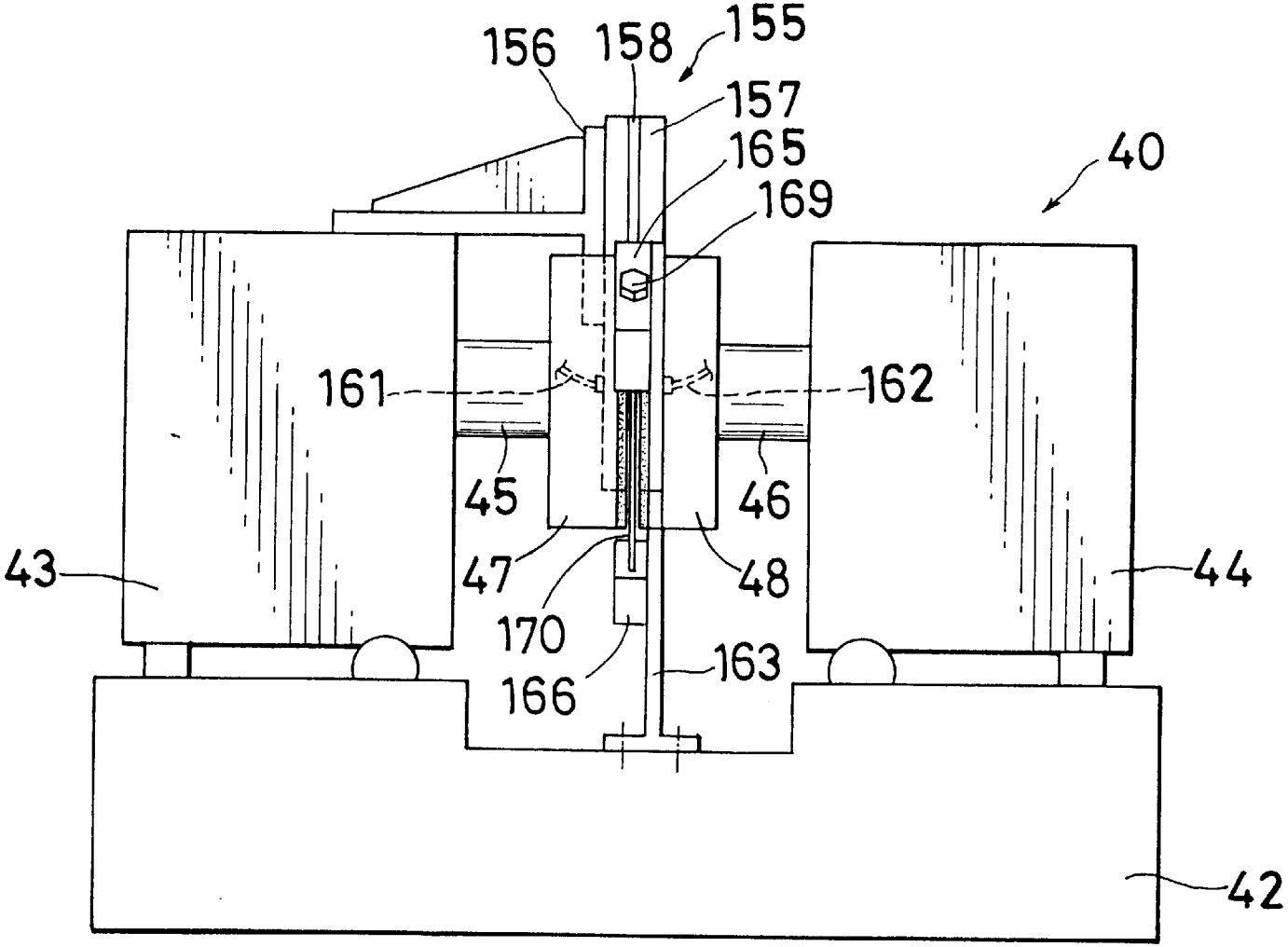
FIG. 25 is a front view schematically showing a double side grinding apparatus as a ninth embodiment of the invention.
Figure 26:
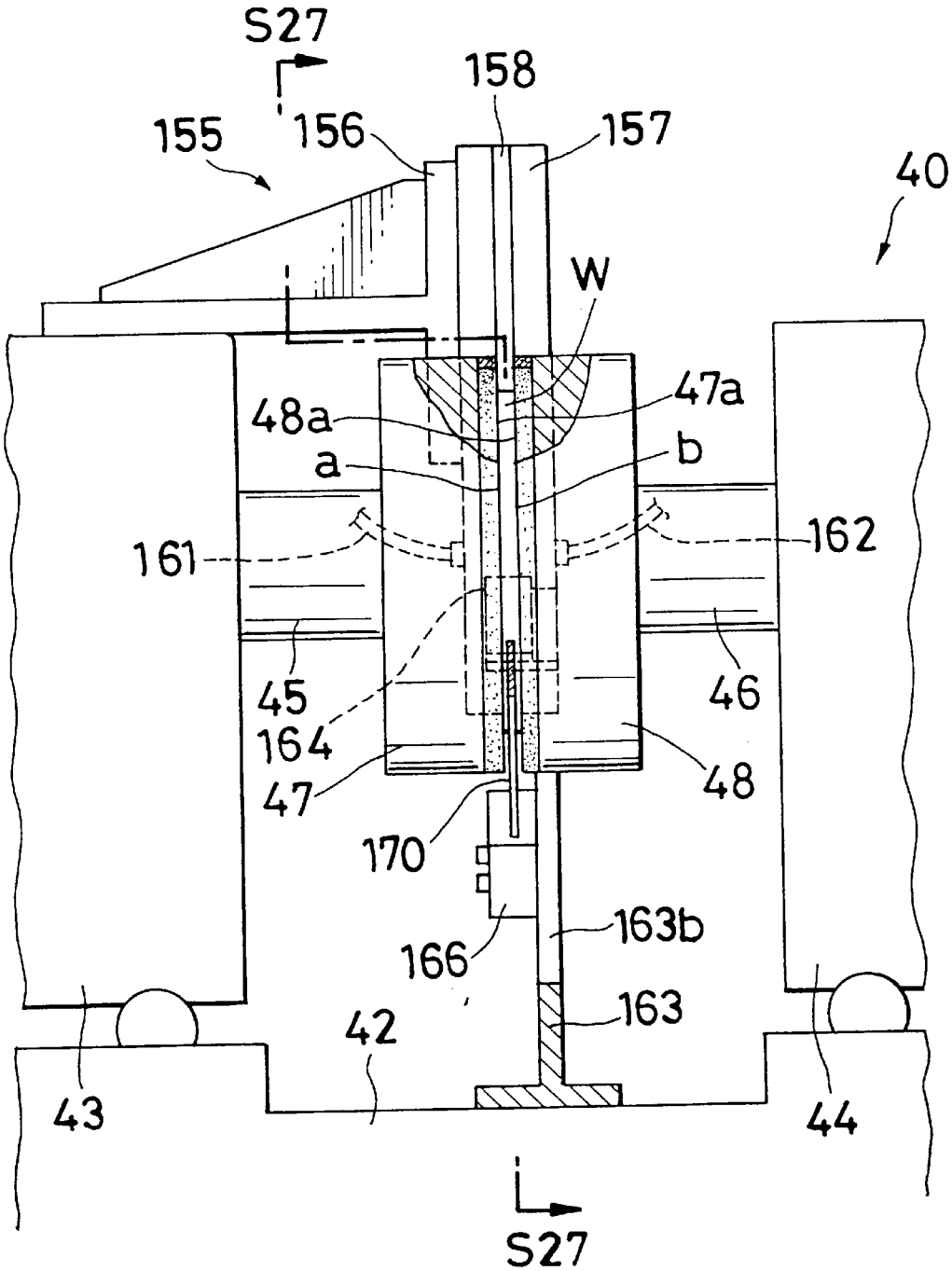
FIG. 26 is a front view partly broken away and showing on an enlarged scale the main portion of a work rotating device included in the ninth embodiment (a view in section taken along the line S26—S26 in FIG. 27)
Figure 27:
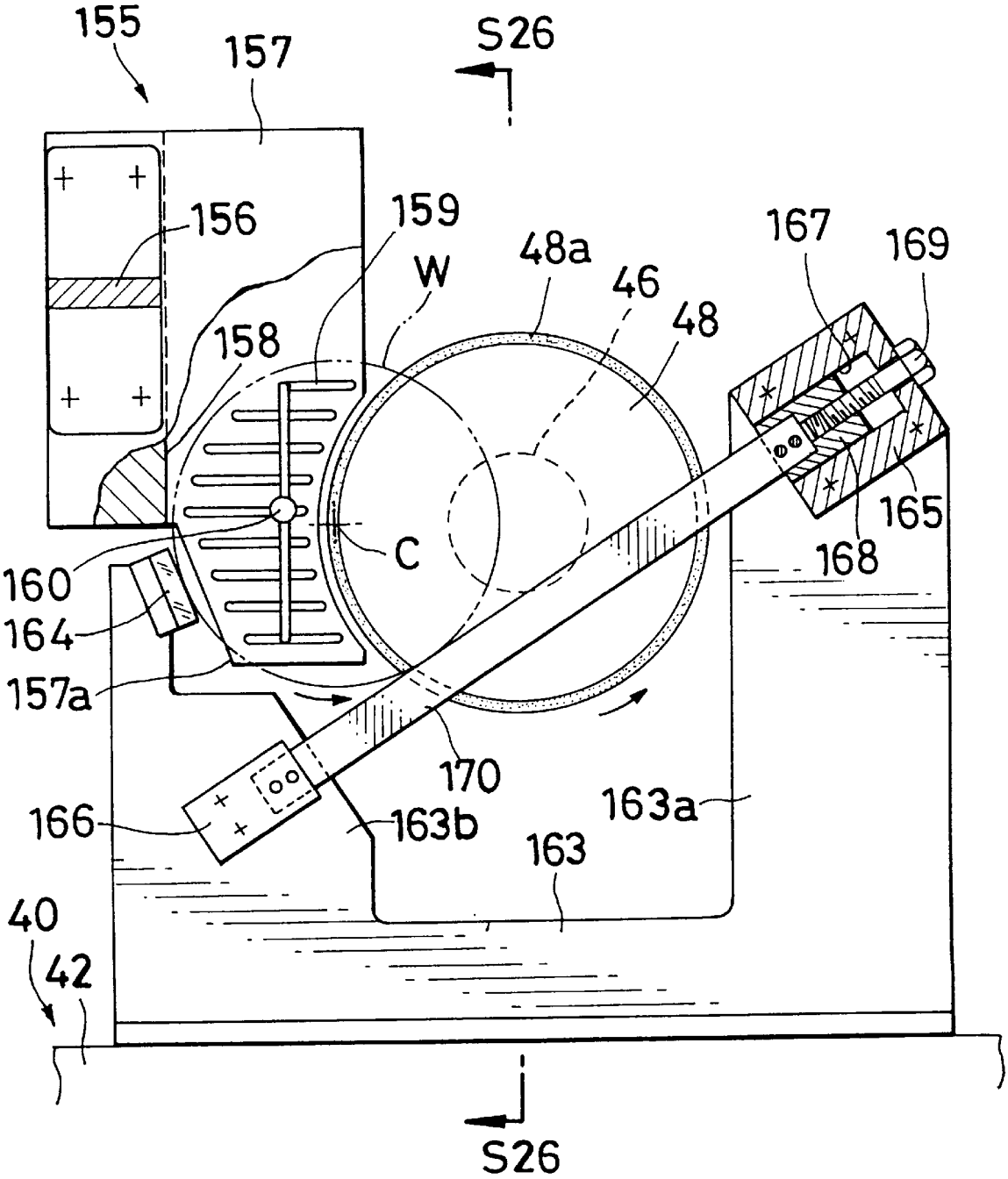
FIG. 27 is a view in section taken along the line S27—S27 in FIG. 26.

FIGS. 25 to 27 show a ninth embodiment. FIG. 25 shows the overall construction of the embodiment, which is a double side grinding apparatus. The ninth embodiment is used for work having no positioning flat portion. The grinding apparatus comprises a horizontal spindle double head surface grinding machine 40, and a work rotating device 155 added to the machine. The rotating device 155 is shown in detail in FIGS. 26 and 27. In the following description of this embodiment, the front side of the plane of FIG. 25 will be referred to as the "front", and the rear side thereof as the "rear," and the terms "right" and "left" will be used for the apparatus as it is seen from the front rearward. Thus, the right- and left-hand sides of FIG. 25 will be referred to respectively as "right" and "left."

The grinding machine 40 is the same as the machine included in the sixth embodiment. The left and right grinding wheels 47, 48 are rotated in the same direction (counterclockwise when seen from left) at the same speed also in this embodiment.

The work rotating device 155 is provided on the bed 42 and left wheel head 43.

Fixedly mounted on the upper side of the head 43 is a base 156 projecting rightward from the head 43. A static pressure support block 157 similar to the one included in the sixth embodiment is fixed at its upper portion to the right end of the base 156. The block 157 has a front portion projecting downward beyond the base 156. The lower portion of the block 157 including this projection 157*a* is formed with an inwardly curved circular-arc front edge having a diameter slightly greater than the outside diameter of the wheels 47, 48. The circular-arc portion is positioned immediately behind the wheels 47, 48. The front portion of the block 157 including the projection 157*a* is formed with a slit 158 extending over the entire height of the block and also to the front edge. The right-to-left width of the slit 158 is slightly greater than the thickness of the work W. At the lower portion of the block 157, the opposed surfaces of the right and left walls defining the slit 158 are formed with static pressure grooves 159. The grooves in the walls are in communication with air supply hoses 161, 162 through air supply bores 160.

A vertical support plate 163 extending forward, rearward and upward is fixed to the upper side of the bed 42 between the opposed wheel heads 43, 44. The support plate 163 is generally channel-shaped when seen from the right or left and has a front projection 163*a* extending upward at the front side of the wheels 47, 48 to upper portions thereof and a rear projection 163*b* extending upward at the rear side of the wheels 47, 48 nearly to the midportion of their height. A first shoe 164 is secured to the upper end of the rear projection 163*b* of the support plate 163 for supporting the outer periphery of the work W in contact therewith. The shoe 164 has a front surface facing obliquely upward for supporting the work, and a right-to-left width greater than the thickness of the work W. The shoe 164 is positioned immediately in the rear of the slit 158 in the projection 157*a* of the block 157 and at a level slightly lower than the axis of the wheels 47, 48. Support member 165, 166 each in the form of a block are positioned obliquely and fixed respectively to the upper end of the support plate front projection 163*a* and to the left surface of lower portion of the rear projection 163*a*. A movable member 168 is movably fitted in a bore 167 having a bottom and formed in one end of the front support member 165 which end faces rearwardly downward. The movable member 168 is screwed on a bolt 169 rotatably inserted through the bottom wall of the bore 167 from outside, such that the position of the movable member 168 is adjustable by rotating the bolt 169. A second shoe 170 in the form of a steel strip is secured at opposite ends to the movable member 168 and the rear support member 166. The shoe 170 is held tensioned by pulling the movable member 168 obliquely forward by the bolt 169. The second shoe 170 has a right-to-left thickness slightly smaller than the thickness of the work W, and a narrow oblique upper face which is adapted for contact with the outer periphery of the work W to support the work. With respect to the right-left direction (lateral direction), the second shoe 170 is positioned generally in coincidence with the center of the slit 158 of the block 157. The shoe 170 is positioned between the opposed wheels 47, 48 and extends below the block 157 and below the axis of the wheels 47, 48 from a rear lower location upward toward the front.

The pair of shoes 164, 170 provide radial support means for defining the position of the work W radially thereof. The shoes and the wheels 47, 48 provide drive means for rotating the work W.

Although not shown, the grinding apparatus is equipped with an autoloader as is the case with the sixth embodiment.

The work W is ground, for example, in the following manner.

First, the work W is fed by the autoloader to a space between the right and left grinding wheels 47, 48 through the slit 158 of the block 157 and placed on the two shoes 164, 170, whereupon the autoloader releases the work W and moves upward to a standby position. Consequently, approximately one-half front portion of the work W is positioned between the right and left wheels 47, 48, with approximately one-half rear portion thereof positioned in the lower portion of the slit 158, and the work W is contactlessly supported axially thereof with the static pressure of air supplied to the grooves 159 of the block 157 and is also supported by the shoes 164, 170 radially thereof. At this time, the rear portion of the work W projecting outward from the block 157 and slightly below the center c thereof is supported by the first shoe 164, and the front portion positioned externally of the block 157, between the wheels 47, 48 and slightly forward of the center c is supported by the second shoe 170.

With the work W supported in the grinding position, the wheels 47, 48 are moved toward each other, bringing the grinding faces 47*a*, 48*a* into contact with the corresponding work surfaces a, b, whereby the front portion of the work W is held between the wheels 47, 48, with the center c of the work W positioned between the outer and inner peripheries of rear portions of the grinding faces 47*a*, 48*a*. Since the outer periphery of the work W is merely in contact with the shoes 164, 170 with nothing preventing the rotation of the work W, the work W receives a rotational force from the wheels 47, 48 which are in rotation in the same direction and rotates while sliding on the shoes 164, 170 and being pressed against these shoes. Consequently, the work W rotates approximately about its center c in the same direction as the wheels 47, 48 (counterclockwise when seen from the left).

The wheels 47, 48 are moved to predetermined grinding positions which are dependent on the dimension to which the work W is to be finished, and held in these positions for a specified period of time. During this period, both work surfaces a, b are entirely ground at the same time in the same manner as in the sixth embodiment, by virtue of the rotation of the wheels 47, 48 and the resulting rotation of the work.

On completion of grinding, the wheels 47, 48 move out of contact with the work leftward and rearward to their standby positions. When released from the wheels 47, 48, the work W is no longer given any rotational drive force and therefore comes to a stop. The autoloader then unload the work W upward through the slit 158 of the block 157.

With the exception of the above features, the ninth embodiment operates in the same manner as the sixth embodiment.

Although air is supplied to the axial support means of the static pressure type according to the sixth to ninth embodiments, other fluid such as water for use in grinding may alternatively be supplied.

The sixth, seventh and ninth embodiments may also be so adapted that the work rotating device reciprocatingly moves the work in directions parallel to the grinding faces while rotating the work about its own axis. In this case, the reciprocating means may have a desired construction; both the axial support means of the static pressure type and the radial support drive means may be reciprocatingly moved, or only the radial support means may be so moved. The axial support means of the static pressure type is intended to contactlessly support the work with a static pressure, so that only the radial support drive means may be reciprocatingly moved without reciprocating the axial support means of this type, whereby the work can also be reciprocatingly moved.

Although the sixth to ninth embodiments are horizontal spindle double side grinding apparatus wherein the grinding wheels have a horizontal axis, the same construction as described above can be modified to provide vertical spindle apparatus wherein the wheels have a vertical axis.

The present invention is usable also for grinding thin disklike workpieces other than semiconductor wafers.

What is claimed is:

1. A double side grinding apparatus for thin work in the form of a disk having first and second work surfaces, an outer periphery and an axis, said apparatus comprising a pair of rotatable grinding wheels having opposed circular grinding faces provided by respective end faces and so arranged as to be movable relative to each other axially thereof, and work rotating means for rotating the thin work about its own axis while supporting the work in a grinding position between the grinding faces so that opposite work surfaces of the work to be worked on face the respective grinding faces of the pair of the wheels, with the outer periphery of the work intersecting an outer periphery of each grinding face and with the center of the work positioned inwardly of the grinding faces, the apparatus being characterized in that the work rotating means comprises radial support means contacting the outer periphery of the work at a portion thereof projecting outward from between the grinding wheels to define the position of the work radially thereof, and axial support means separate from the radial support means contacting the work surfaces inwardly of the outer periphery of the work to hold therebetween the work portion projecting outward from between the grinding wheels and to define the position of the work axially thereof, at least one of the radial support means and the axial support means being provided with drive means for rotating the work.

2. A double side grinding apparatus for thin work as defined in claim 1 which is characterized in that the work rotating means comprises means for reciprocatingly moving the work in directions parallel to the grinding faces while rotating the work about its own axis.

3. A double side grinding apparatus for thin work as defined in claim 1 which is characterized in that the radial support means comprises at least three radial support rollers adapted to contact the outer periphery of the work at a portion thereof projecting outward from between the grinding wheels to define the position of the work radially thereof.

4. A double side grinding apparatus for thin work as defined in claim 3 which is characterized in that axial support means comprises at least three pairs of axial support rollers adapted for pressing contact with the work surfaces to hold therebetween the work portion projecting outward from between the grinding wheels and to define the position of the work axially thereof, at least one of the axial support rollers being a drive roller rotatable in pressing contact with the work surface to rotate the work, the other axial support rollers being holding rollers idly rotatable in pressing contact with the work surface.

5. A double side grinding apparatus for thin work as defined in claim 4 which is characterized in that of the axial support rollers, those on one side of the work are pressed into contact with one of the work surfaces by an elastic force to press the other work surface into contact with the other axial support rollers on the other side.

6. A double side grinding apparatus for thin work as defined in claim 4 which is characterized in that the axial support rollers on one side of the work are all holding rollers and are attached to a common first support member, and the radial support rollers and the axial support rollers including the drive roller and disposed on the other side are attached to a common second support member, the support members being movable relative to each other in the axial direction.

7. A double side grinding apparatus for thin work as defined in claim 3 which is characterized in that the axial support means comprises a pair of drive belts movable in contact with two portions of one of the work surfaces projecting outward from between the grinding wheels to rotate the work, and axial support rollers adapted for pressing contact with the other work surface to hold the work between each drive belt and each axial support roller.

8. A double side grinding apparatus for thin work as defined in claim 7 which is characterized in that the pair of drive belts are arranged in parallel to each other and each have a work support portion with a surface facing upward for contact with the work, the pair of drive belts being drivable in a work loading state in which the work support portions move in the same loading direction to load the work as placed thereon in the grinding position, a work unloading state in which the work support portions move in the same unloading direction to unload the work as placed thereon from the grinding position or a work rotating state in which the work support portions move in directions opposite to each other to rotate the work as placed thereon, as changed over from one of the states to another, the axial support rollers being movable upward and downward between a standby position wherein the rollers are upwardly away from the world on the drive belts and an operating position wherein the rollers are in pressing contact with the work on the drive belt, the radial support means comprising at least two fixed radial support rollers for stopping the work by coming into contact with the outer periphery of the work as transported by the pair of drive belts in the work loading state at a forward work portion with respect to the direction of transport, and at least one movable radial support roller adapted to come into contact with the outer periphery of the work as stopped by the fixed radial support rollers at a rearward work portion with respect to the direction of transport, the movable radial support roller being movable upward and downward between a standby position wherein the roller is upwardly away from the work on the drive belts and an operating position wherein the roller is in contact with the outer periphery of the work on the drive belt.

9. A double-side grinding apparatus for thin work as defined in claim 8 which is characterized in that the work support portions of the pair of drive belts are each guided by a guide member disposed thereunder.

10. A double side grinding apparatus for thin work as defined in claim 8 which is characterized in that each axial support roller and the movable radial support roller are attached to a lift member and movable upward and downward as timed with each other.

11. A double side grinding apparatus for thin work comprising a pair of rotatable grinding wheels having opposed circular grinding faces provided by respective end faces and so arranged as to be movable relative to each other axially thereof, and work rotating means for rotating the thin work about its own axis while supporting the work in a grinding position between the grinding faces so that opposite surfaces of the work to be worked on face the respective grinding faces of the pair of the wheels, with an outer periphery of the work intersecting an outer periphery of each grinding face and with the center of the work positioned inwardly of the grinding faces, the apparatus being characterized in that the work rotating means comprises radial support means contacting the outer periphery of the work at a portion thereof projecting outward from between the grinding wheels to define the position of the work radially thereof, and static pressure type axial support means supplying a fluid to the opposite surface of the work at a portion thereof projecting outward from between the grinding wheels to contactlessly support the work axially thereof with the static pressure of the fluid, the radial support means being provided with the drive means.

12. A double side grinding apparatus for thin work as defined in claim 11 which is characterized in that the radial support means comprises at least two radial support rollers adapted to contact the outer periphery of the work to define the position of the work radially thereof, at least one of the radial support rollers being a drive roller for rotating the work.

13. A double side grinding apparatus for thin work as defined in claim 11 which is characterized in that each of the grinding wheels has an outer peripheral portion with an annular end face serving as the grinding face, the radial support means comprising at least two radial support rollers adapted to contact the outer periphery of the work to define the position of the work radially thereof, one of the radial support rollers being attached to the center of one of the grinding wheels inwardly of the grinding face thereof so as to be rotatable about the axis of said one grinding wheel and to contact the outer periphery of the work at a portion thereof positioned between the grinding wheels the other radial support roller being adapted to contact the outer periphery of the work at a portion thereof projecting outward from between the grinding wheels and positioned externally of the axial support means, one of the radial support rollers being a drive roller for rotating the work.

14. A double side grinding apparatus for thin work as defined in claim 11 which is characterized in that the radial support means comprises at least two pairs of radial support rollers adapted to contact the outer periphery of the work at a portion thereof projecting outward from between the grinding wheels and positioned externally of the axial support means to define the position of the work radially thereof, each of the pairs of radial support rollers being spaced apart by a distance greater than the circumferential dimension of a positioning flat portion in the outer periphery of the work, at least two of the radial support rollers being drive rollers for rotating the work.

15. A double side grinding apparatus for thin work as defined in claim 11 which is characterized in that the radial support means comprises a pair of belts so arranged as to come into contact with the outer periphery of the work by holding the work from radial opposite sides at a portion thereof projecting outward from between the grinding wheels and positioned externally of the axial support means and to be movable circumferentially of the work, at least one of the belts being a drive belt drivable circumferentially of the work to thereby rotate the work.

16. A double side grinding apparatus for thin work as defined in claim 11 which is characterized in that the radial support means comprises shoes adapted to contact the outer periphery of the work at predetermined two portions thereof, the work being rotatable by the rotational force of the grinding wheels and the operation of the shoes.

* * * * *